US011370233B2

(12) United States Patent
Yoshida et al.

(10) Patent No.: US 11,370,233 B2
(45) Date of Patent: Jun. 28, 2022

(54) BASE MATERIAL PROCESSING APPARATUS AND BASE MATERIAL PROCESSING METHOD

(71) Applicant: SCREEN HOLDINGS CO., LTD., Kyoto (JP)

(72) Inventors: Mitsuhiro Yoshida, Kyoto (JP); Hiroaki Usumoto, Kyoto (JP); Takaharu Yamamoto, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 16 days.

(21) Appl. No.: 16/956,661

(22) PCT Filed: Dec. 11, 2018

(86) PCT No.: PCT/JP2018/045466

§ 371 (c)(1),
(2) Date: Jun. 22, 2020

(87) PCT Pub. No.: WO2019/131104

PCT Pub. Date: Jul. 4, 2019

(65) Prior Publication Data

US 2020/0406639 A1 Dec. 31, 2020

(30) Foreign Application Priority Data

Dec. 27, 2017 (JP) ..... JP2017-250451

(51) Int. Cl.
*B41J 11/00* (2006.01)
*B41J 15/04* (2006.01)
(Continued)

(52) U.S. Cl.
CPC ..... *B41J 11/0095* (2013.01); *B41J 15/04* (2013.01); *B65H 20/02* (2013.01); *B65H 23/188* (2013.01)

(58) Field of Classification Search
CPC ..... B41J 11/0095; B41J 11/008; B41J 15/04; B41J 13/0009; B41J 2029/3935;
(Continued)

(56) References Cited

U.S. PATENT DOCUMENTS 6,118,132 A 9/2000 Tullis
7,878,617 B2 2/2011 Mizes et al.
(Continued)

FOREIGN PATENT DOCUMENTS

EP 0 729 846 A2 9/1996
EP 2 167 411 A1 3/2010
(Continued)

OTHER PUBLICATIONS

International Search Report issued in corresponding International Patent Application No. PCT/JP2018/045466, dated Jan. 15, 2019, with English translation.
(Continued)

*Primary Examiner* — Jannelle M Lebron
(74) *Attorney, Agent, or Firm* — McDermott Will & Emery LLP

(57) ABSTRACT

A base material processing apparatus includes a transport mechanism, a mark detector, and a calculating unit. The transport mechanism transports an elongated strip-shaped base material in a longitudinal direction thereof along a predetermined transport path. The mark detector acquires a detection result by detecting a mark continuously at a detecting position on the transport path. The mark is applied previously to an end of the base material in a width direction thereof. The calculating unit calculates a transport speed of the base material, the amount of positional deviation of the base material in a transport direction, and tension on the base material applied in the transport direction on the basis of the detection result and information about the mark applied previously to the base material.

16 Claims, 16 Drawing Sheets

(51) Int. Cl.
*B65H 20/02* (2006.01)
*B65H 23/188* (2006.01)

(58) Field of Classification Search
CPC . B41J 29/393; B41J 11/42; B41J 13/26; B41J 19/205; B41J 2/04508; B65H 23/038; B65H 23/1888; B65H 20/02; B65H 20/34; B65H 23/188
See application file for complete search history.

(56) References Cited

U.S. PATENT DOCUMENTS

| | | | |
|---|---|---|---|
| 8,847,185 | B2 | 9/2014 | Theis et al. |
| 2005/0087578 | A1 | 4/2005 | Jackson |
| 2016/0075155 | A1 | 3/2016 | Fukui et al. |

FOREIGN PATENT DOCUMENTS

| | | | |
|---|---|---|---|
| JP | 2001-315290 | A | 11/2001 |
| JP | 2016-013681 | A | 1/2016 |
| JP | 2016-055570 | A | 4/2016 |
| JP | 2016-087891 | A | 5/2016 |
| JP | 2017-206355 | A | 11/2017 |

OTHER PUBLICATIONS

Extended European Search Report issued in corresponding European Patent Application No. 18896514.9-1017, dated Sep. 8, 2021.

BASE MATERIAL PROCESSING APPARATUS AND BASE MATERIAL PROCESSING METHOD

CROSS REFERENCE TO RELATED APPLICATIONS

This application is the U.S. National Phase under 35 U.S.C. § 371 of International Patent Application No. PCT/JP2018/045466, filed on Dec. 11, 2018, which claims the benefits of Japanese Patent Application No. 2017-250451, filed on Dec. 27, 2017 the entire contents of which are hereby incorporated by reference.

TECHNICAL FIELD

The present invention relates to a base material processing apparatus and a base material processing method.

BACKGROUND ART

In a base material processing apparatus conventionally known, an elongated strip-shaped base material is subjected to a process while being transported in a longitudinal direction thereof along a predetermined transport path. This type of base material processing apparatus is disclosed in patent literature 1, for example.

CITATION LIST

Patent Literature

Patent Literature 1: Japanese Patent Application Laid-Open No. 2016-55570

A printing apparats (base material processing apparatus) disclosed in patent literature 1 includes a transport mechanism that transports a web (base material), a printing head (processing unit) that prints an image on the web while the web is transported, a serpentine amount sensor, and a correcting unit. The serpentine amount sensor detects a serpentine amount caused by the transport of the web at a position in which the printing head is disposed or a position therearound. In the printing apparatus disclosed in patent literature 1, a serpentine amount expected to occur in a following web is predicted in response to the serpentine amount detected by the serpentine amount sensor. To shift a printing position of an image in a width direction of the web in response to the predicted serpentine amount, the correcting unit corrects the printing position of the image and applies a corrected printing position to the printing head.

In the printing apparatus disclosed in patent literature 1, the serpentine amount sensor detects the serpentine amount of the web while the web is transported, and deviation of an actual printing position from an intended printing position in the width direction is prevented using a result of this detection. In view of this, information about the serpentine amount of the web, namely, about the amount of positional deviation of the web in the width direction, can be said to be information necessary for performing a printing process properly on the web while the web is transported.

In a base material processing apparatus such as the one described above, as processes are performed sequentially on the base material while the base material is transported, or as a result of the motion of each part such as a roller forming the transport mechanism, the position of the base material in a transport direction may unintentionally be deviated from an ideal position. This causes a risk of deviation of an actual printing position from an intended printing position in the transport direction. From this point of view, information about the base material such as a transport speed, the amount of positional deviation in the transport direction, and tension applied in the transport direction can also be said to be information necessary for performing a process properly on the base material.

SUMMARY OF INVENTION

Technical Problem

A possible method of seeing the amount of positional deviation in the transport direction and others of the base material is to make detectors installed on several positions in the transport direction detect a fine shape appearing at an end (edge) of the base material in the width direction, and to compare results of the detections, for example. This method is inapplicable, however, if the base material is a material such as a film where a characteristic shape cannot be found at an end thereof in a width direction.

The present invention has been made in view of the foregoing circumstances, and is potentially intended to provide a base material processing apparatus and a base material processing method widely applicable to various types of base materials for acquiring information including at least any of a transport speed of a base material, the amount of positional deviation of the base material in a transport direction, and tension on the base material applied in the transport direction.

Solution to Problem

The problem to be solved by the present invention is as has been described above. Means for solving the problem and effect achieved by the means will be described next.

According to a first aspect of the present invention, a base material processing apparatus including a transport mechanism, a mark detector, and a calculating unit is provided. The transport mechanism transports an elongated strip-shaped base material in a longitudinal direction thereof along a predetermined transport path. The mark detector acquires a detection result by detecting a mark continuously or intermittently at a detecting position on the transport path. The mark is applied previously to an end of the base material in a width direction thereof. The calculating unit calculates at least any of a transport speed of the base material, the amount of positional deviation of the base material in a transport direction, and tension on the base material applied in the transport direction on the basis of the detection result and information about the mark applied previously to the base material.

According to a second aspect of the present invention, the base material processing apparatus according to the first aspect further includes a mark applicator that applies the mark at an applying position upstream of the transport path from the detecting position to the end of the base material in the width direction.

According to a third aspect of the present invention, the base material processing apparatus according to the second aspect is configured as follows. The base material processing apparatus further includes a second mark detector that acquires a second detection result by detecting the mark continuously or intermittently at a second detecting position downstream of the transport path from the detecting position. The calculating unit calculates at least any of a transport speed of the base material, the amount of positional deviation of the base material in the transport direction, and tension on the base material applied in the transport direction by comparing the detection result and the second detection result.

According to a fourth aspect of the present invention, in the base material processing apparatus according to the second aspect or the third aspect, the mark is a periodic pattern.

According to a fifth aspect of the present invention, in the base material processing apparatus according to any one of the second aspect to the fourth aspect, the mark is a continuous pattern.

According to a sixth aspect of the present invention, in the base material processing apparatus according to any one of the second aspect to the fifth aspect, the mark applicator is a processing unit that performs a process on a surface of the base material.

According to a seventh aspect of the present invention, in the base material processing apparatus according to the sixth aspect, the processing unit is an image recording unit that records an image by ejecting ink to the surface of the base material.

According to an eighth aspect of the present invention, the base material processing apparatus according to the seventh aspect further includes an image recording time correcting unit that corrects timing of ejection of the ink from the image recording unit on the basis of a calculation result obtained by the calculating unit.

According to a ninth aspect of the present invention, the base material processing apparatus according to the seventh aspect or the eighth aspect further includes a transport motion correcting unit that corrects the motion of the transport mechanism on the basis of a calculation result obtained by the calculating unit.

According to a tenth aspect of the present invention, in the base material processing apparatus according to any one of the first aspect to the ninth aspect, the base material is a transparent film.

According to an eleventh aspect of the present invention, in the base material processing apparatus according to the tenth aspect, the mark detector includes: a light-projecting part that projects light toward a front side of the base material; and a light-receiving part that receives the light from the light-projecting part on a rear side of the base material.

According to a twelfth aspect of the present invention, the base material processing apparatus according to any one of the second aspect to the fifth aspect is configured as follows. The mark applicator is a plurality of image recording units arranged at intervals along the transport path. The image recording units record images by ejecting different inks to a surface of the base material. The image recording units record images each functioning as the mark at respective positions differing from each other in the width direction. The calculating unit calculates at least any of a transport speed of the base material, the amount of positional deviation of the base material in the transport direction, and tension on the base material applied in the transport direction on the basis of each of the marks applied to the positions differing in the width direction.

According to a thirteenth aspect of the present invention, the base material processing apparatus according to the twelfth aspect further includes an image recording time correcting unit. The image recording time correcting unit corrects timing of ejection of the ink from each of the image recording units on the basis of a calculation result obtained by the calculating unit.

According to a fourteenth aspect of the present invention, the base material processing apparatus according to any one of the first aspect to the fifth aspect is configured as follows. The mark detector is an edge sensor that acquires the position of an edge of the base material in the width direction continuously or intermittently as a signal. The base material processing apparatus further includes a filtering processing unit that removes a signal in a lower frequency region than a signal resulting from the mark from the signal detected by the edge sensor.

According to a fifteenth aspect of the present invention, a base material processing method is provided by which steps a) to c) described later are performed. In the step a), a mark is applied at an applying position on a transport path along which an elongated strip-shaped base material is transported by a transport mechanism in a longitudinal direction thereof. The mark is applied to an end of the base material in a width direction thereof. In the step b), a detection result is acquired by detecting the mark continuously or intermittently at a detecting position downstream of the transport path from the applying position. In the step c), at least any of a transport speed of the base material, the amount of positional deviation of the base material in a transport direction, and tension on the base material applied in the transport direction is calculated on the basis of the detection result and information about the mark.

According to a sixteenth aspect of the present invention, in the base material processing method according to the fifteenth aspect, the following step d) is performed after the step c). In the step d), at least either timing of performing a process on a surface of the base material or the motion of the transport mechanism is corrected in consideration of a calculation result that is at least any of a transport speed of the base material, the amount of positional deviation of the base material in the transport direction, and tension on the base material applied in the transport direction.

Advantageous Effects of Invention

According to the first aspect to the sixteenth aspect of the present invention, the base material processing apparatus and the base material processing method are provided that are widely applicable to various types of base materials for acquiring information including at least any of a transport speed of a base material, the amount of positional deviation of the base material in a transport direction, and tension on the base material applied in the transport direction.

In particular, according to the first aspect of the present invention, even if the base material does not have a characteristic shape at the end thereof in the width direction, it is still possible to acquire information such as a transport speed, the amount of positional deviation in the transport direction, and tension applied in the transport direction using the mark applied previously and intentionally to the end of the base material in the width direction.

In particular, the second aspect of the present invention makes it possible to acquire a transport speed, the amount of positional deviation in the transport direction, and tension applied in the transport direction of the base material specifically through comparison between information about the mark applied by the mark applicator and the detection result obtained by the mark detector.

In particular, according to the third aspect of the present invention, even if the applied mark does not conform to an intention, it is still possible to determine a transport speed, the amount of positional deviation in the transport direction, and tension applied in the transport direction of the base material with high accuracy through comparison between results obtained by detecting the same mark at the detecting positions defined at a plurality of places in the transport direction.

In particular, the fourth aspect of the present invention facilitates application of the mark at low cost by employing a method such as cutting the end of the base material in the width direction continuously using a cutter with a blade bent at a predetermined angle, for example.

In particular, the fifth aspect of the present invention allows the mark to be detected stably and uninterruptedly. Further, making the mark detector monitor the continuous shape of the mark allows grasping of information such as expansion and contraction of the base material in the transport direction more easily.

In particular, the sixth aspect of the present invention allows application of the mark to the end of the base material in the width direction along with implementation of a process on a surface of the base material. This allows the base material processing apparatus to operate with no waste.

In particular, the seventh aspect of the present invention allows recording of the mark as an image on the end of the base material in the width direction. This makes it possible to prevent the occurrence of a broken piece of the base material, for example, during application of the mark. This further facilitates formation of the mark into a complicated pattern.

In particular, the eighth aspect of the present invention allows adjustment of timing of ejection of ink in consideration of a calculation result about the base material such as the amount of positional deviation in the transport direction and a transport speed. Thus, the ink is to adhere to a more appropriate position on the base material.

In particular, the ninth aspect of the present invention allows the base material to be adjusted in terms of a transport speed, tension, and others in consideration of a calculation result such as the amount of positional deviation in the transport direction, a transport speed, and tension of the base material. Thus, it becomes possible to perform a process such as recording of an image on the base material more properly.

Generally, a characteristic shape at an end in a width direction is hard to find in a base material such as a transparent film if the base material is used as it is. According to the tenth aspect of the present invention, the mark is applied intentionally to the end of the base material in the width direction. Thus, even in such a case, it is still possible to acquire information such as a transport speed, the amount of positional deviation in the transport direction, and tension applied in the transport direction of the base material.

According to the eleventh aspect of the present invention, a large difference is produced between the quantity of light received on the back side of a place in the presence of the applied mark and the quantity of light received on the back side of a place in the absence of the applied mark. This allows the mark to be detected easily.

According to the twelfth aspect of the present invention, by acquiring calculation results about the marks applied by the respective image recording units and comparing the acquired calculation results, it becomes possible to determine the amount of positional deviation, a degree of change in a transport speed, a degree of change in tension, and others occurring between the image recording units adjacent to each other in the transport direction.

In particular, in the presence of different colors of ink, for example, the thirteenth aspect of the present invention allows adjustment such as that of timing of ejection of ink in consideration of the amount of positional deviation and others occurring between the image recording units adjacent to each other in the transport direction. As a result, color matching can be done with high accuracy, making it possible to reduce the occurrence of misregistration.

According to the fourteenth aspect of the present invention, the signal in the low-frequency region resulting from serpentine motion or warpage of the base material is removed to allow the signal resulting from the mark to be detected with high accuracy.

According to the fifteenth aspect of the present invention, even if the base material does not have a characteristic shape at the end thereof in the width direction, it is still possible to acquire information about the base material such as a transport speed, the amount of positional deviation in the transport direction, and tension applied in the transport direction by comparing information about the mark applied intentionally to the end of the base material in the width direction and a detection result obtained by detecting the mark on a downstream side.

In particular, the sixteenth aspect of the present invention allows correction of timing of performing a process such as image recording on a surface of the base material or correction of the motion of the transport mechanism appropriately in consideration of the amount of positional deviation of the base material in the transport direction and others. This makes it possible to perform the process properly on the base material while the base material is transported.

DESCRIPTION OF EMBODIMENTS

Figure 1:
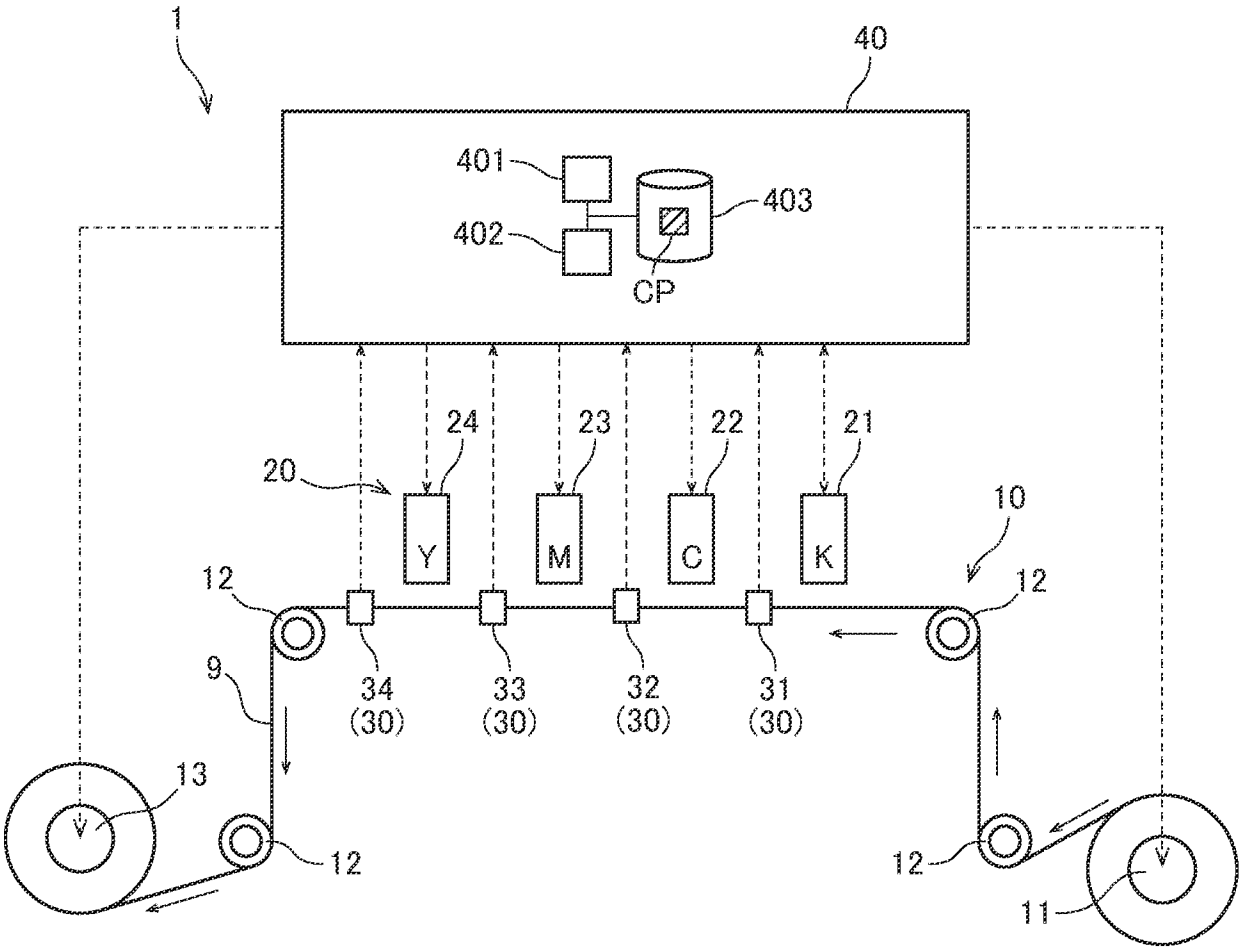
FIG. 1 is a view showing an entire configuration of a base material processing apparatus according to a first embodiment.

Embodiments of the present invention will be described below by referring to the drawings. In the following description, a direction in which a base material is transported may be called a "transport direction," and a horizontal direction vertical to the transport direction may be called a "width direction."

1. First Embodiment

An image recording apparatus (base material processing apparatus) 1 according to a first embodiment of the present invention will be descried below by referring to FIGS. 1 to 6. FIG. 1 briefly shows the configuration of the image recording apparatus 1 that is the base material processing apparatus according to the first embodiment. The image recording apparatus 1 is an apparatus that performs image recording as a process on a surface of a colorless and transparent film 9 that is an elongated strip-shaped base material while transporting the film 9 in a longitudinal direction thereof. More specifically, the image recording apparatus 1 is an inkjet printing apparatus that prints an image on the film 9 by ejecting ink toward the film 9 from a plurality of recording heads 21 to 24 while transporting the film 9 along a predetermined transport path. The image recording apparatus 1 mainly includes a transport mechanism 10, an image recording unit 20, a mark detector 30, and a controller 40.

The transport mechanism 10 is a mechanism that transports the film 9 in the transport direction corresponding to the longitudinal direction thereof. The transport mechanism 10 of this embodiment has a plurality of rollers including an unwinding roller 11, a plurality of transport rollers 12, and a winding roller 13. The film 9 is unwound from the unwinding roller 11, and transported along a transport path configured using the transport rollers 12. Each of the transport rollers 12 rotates about a horizontal axis to guide the film 9 downstream of the transport path. After the film 9 is transported, the film 9 is collected on the winding roller 13. These rollers 11, 12, and 13 are driven to rotate appropriately by the controller 40 described later.

As shown in FIG. 1, the film 9 moves under the plurality of recording heads 21 to 24 to be substantially parallel to a direction in which the recording heads 21 to 24 are aligned. During the move, a recording surface of the film 9 is pointed upwardly (toward the recording heads 21 to 24). While tension is applied to the film 9, the film 9 is stretched around the transport rollers 12. This reduces sags or creases of the film 9 occurring during the transport.

The image recording unit 20 is a processing unit that ejects droplets of ink (hereinafter called "ink droplets") to the film 9 while the film 9 is transported by the transport mechanism 10. The image recording unit 20 of this embodiment includes a first recording head (mark applicator) 21, a second recording head 22, a third recording head 23, and a fourth recording head 24. The first recording head 21, the second recording head 22, the third recording head 23, and the fourth recording head 24 are arranged along the transport path of the film 9.

Figure 2:
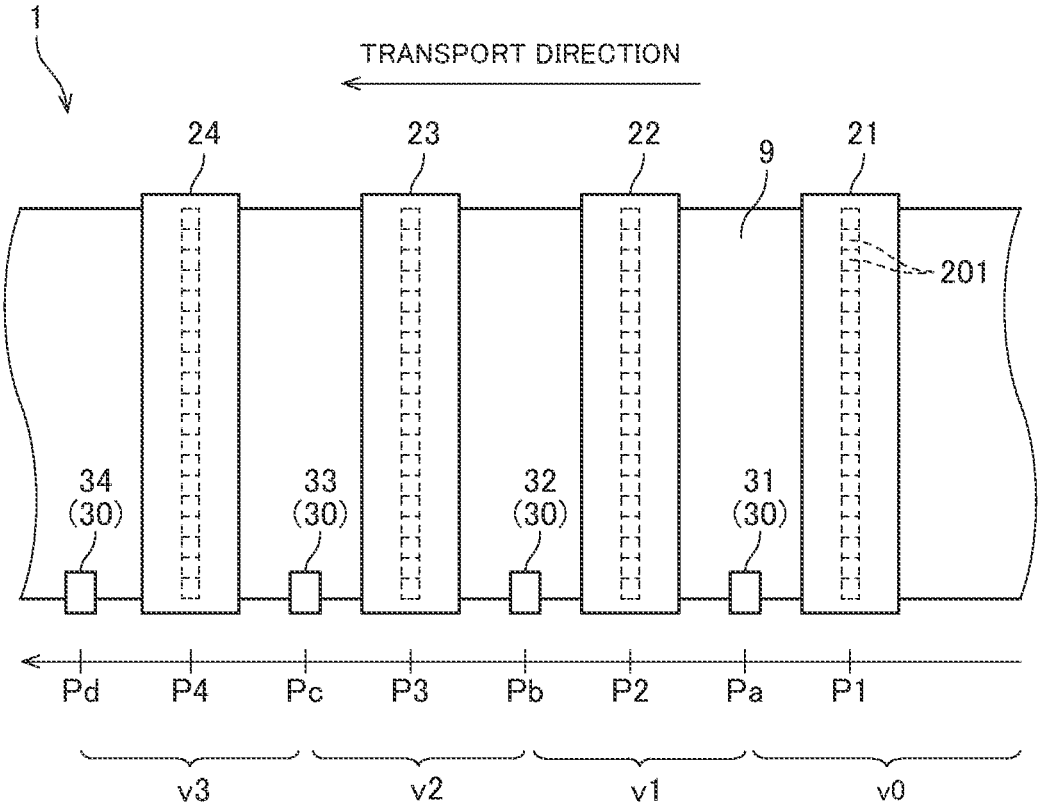
FIG. 2 is a partial top view of the base material processing apparatus according to the first embodiment taken at a processing unit and its vicinity.

FIG. 2 is a partial top view of the image recording apparatus 1 taken at the image recording unit 20 and its vicinity. Each of the four recording heads 21 to 24 covers the film 9 in its entirety in the width direction. As shown by dashed lines in FIG. 2, each of the recording heads 21 to 24 has a lower surface provided with a plurality of nozzles 201 aligned parallel to the width direction of the film 9. The recording heads 21 to 24 eject ink droplets of respective colors that are K (black), C (cyan), M (magenta), and Y (yellow) to become color components of a multi-color image from the nozzles 201 toward the upper surface of the film 9.

More specifically, the first recording head 21 ejects ink droplets of K color (black) at a first processing position P1 on the transport path to the upper surface of the film 9. The second recording head 22 ejects ink droplets of C color (cyan) at a second processing position P2 downstream from the first processing position P1 to the upper surface of the film 9. The third recording head 23 ejects ink droplets of M color (magenta) at a third processing position P3 downstream from the second processing position P2 to the upper surface of the film 9. The fourth recording head 24 ejects ink droplets of Y color (yellow) at a fourth processing position P4 downstream from the third processing position P3 to the upper surface of the film 9. In this embodiment, the first processing position P1, the second processing position P2, the third processing position P3, and the fourth processing position P4 are aligned at regular intervals in the transport direction of the film 9.

The four recording heads 21 to 24 record respective single-color images on the upper surface of the film 9 by ejecting ink droplets. Then, the four single-color images are superimposed on each other to form a multi-color image on the upper surface of the film 9. Hence, if ink droplets ejected from the four recording heads 21 to 24 reach positions on the film 9 deviated from each other in the transport direction, image quality of a printed matter is reduced. Keeping such positional deviation between the single-color images on the film 9 (what is called "misregistration") within an allowable range is an important factor for improving the printing quality of the image recording apparatus 1. In this regard, the image recording apparatus 1 of this embodiment has a characteristic configuration for suppressing positional deviation of ink droplets ejected to the film 9 in the transport direction.

Figure 3:
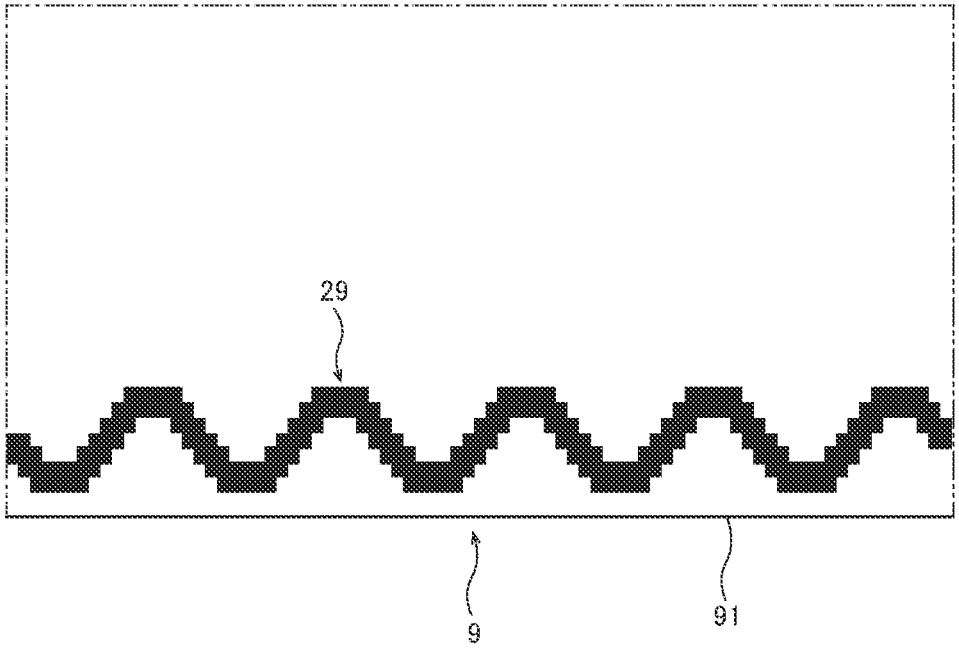
FIG. 3 is a view showing an exemplary mark applied to an end of a base material in a width direction thereof by a mark applicator according to the first embodiment.

More specifically, the first recording head 21 further functions as a mark applicator according to this embodiment. The first recording head 21 records an image as a mark 29 outside an image region of the film 9 in such a manner as to avoid overlap with this image recording region. In another way of saying, the recording head 21 applies the mark 29 by printing to an end of the film 9 in the width direction. FIG. 3 shows the form of the mark 29 according to this embodiment. As shown in FIG. 3, the mark 29 of this embodiment has a pattern with continuous and periodic waves.

The mark detector 30 will be described next by mainly referring to FIGS. 2 and 4. In this embodiment, four mark detectors 30 for detecting the mark 29 applied by the first recording head 21 are provided along the transport path.

Of the four mark detectors 30, a first mark detector 31 is provided at a first mark detecting position Pa that is a position between the first recording head 21 and the second recording head 22 in the transport direction. A second mark detector 32 is provided at a second mark detecting position Pb that is a position between the second recording head 22 and the third recording head 23 in the transport direction. A third mark detector 33 is provided at a third mark detecting position that is a position between the third recording head 23 and the fourth recording head 24 in the transport direction. A fourth mark detector 34 is provided at a fourth mark detecting position Pd that is a position downstream of the transport direction from the fourth recording head 24.

Figure 4:
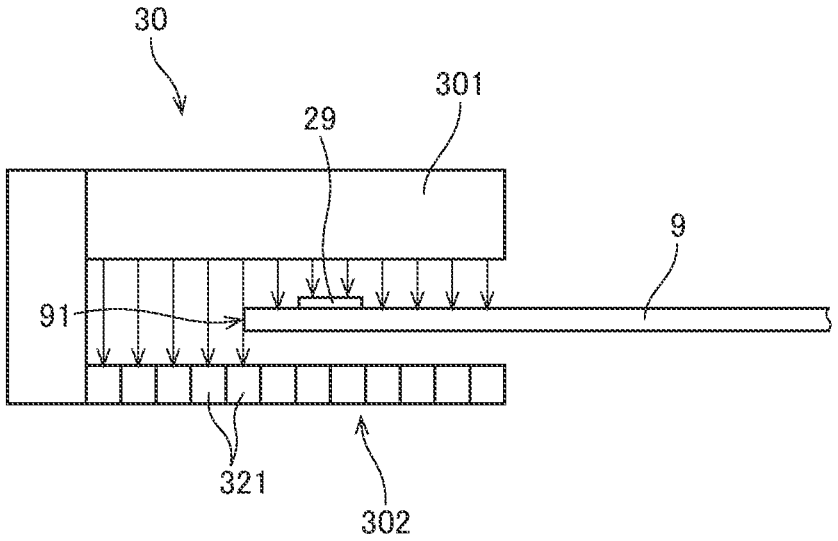
FIG. 4 is a view schematically showing the configuration of a mark detector according to the first embodiment.

FIG. 4 is a view schematically showing the configuration of the mark detector 30. As shown in FIG. 4, the mark detector 30 includes a phototransmitter (light-projecting part) 301 located above an end of the film 9 in the width direction, and a line sensor (light-receiving part) 302 located below the end of the film 9 in the width direction. The phototransmitter 301 emits parallel rays of light toward a front side of the film 9, namely, downwardly. The line sensor 302 receives the rays of light from the phototransmitter 301 on a rear side of the film 9. The line sensor 302 includes a plurality of light-receiving elements 321 aligned in the width direction.

As shown in FIG. 4, at a place of the film 9 given the mark 29, light emitted from the phototransmitter 301 is blocked by this mark 29. Thus, the light-receiving elements 321 do not detect the light. At an edge 91 of the film 9 in the width direction, light emitted from the phototransmitter 301 is reflected diffusely on the edge 91. Thus, the light of a relatively small quantity is received by the light-receiving elements 321. In a region excluding a part where the mark 29 is applied to the film 9 and excluding the edge 91, light emitted from the phototransmitter 301 is detected as it is, in other words, such light is detected substantially entirely by the light-receiving elements 321. On the basis of the quantities of light detected in this way by the plurality of light-receiving elements 321, the mark detector 30 detects the position of the mark 29 in the width direction applied to the film 9 and the position of the edge 91 of the film 9 in the width direction.

At the first mark detecting position Pa, the first mark detector 31 shown in FIG. 2 detects the position of the mark 29 applied to the film 9 and the position of the edge 91 in the width direction intermittently at tiny intervals of time. By doing so, the first mark detector 31 acquires a detection signal indicating chronological change in the position of the mark 29 in the width direction relative to the edge 91 occurring at the first mark detecting position Pa. Then, the first mark detector 31 outputs the acquired detection signal to the controller 40.

At the second mark detecting position Pb, the second mark detector 32 detects the position of the mark 29 applied to the film 9 and the position of the edge 91 in the width direction intermittently at tiny intervals of time. By doing so, the second mark detector 32 acquires a detection signal indicating chronological change in the position of the mark 29 in the width direction relative to the edge 91 occurring at the second mark detecting position Pb. Then, the second mark detector 32 outputs the acquired detection signal to the controller 40.

At the third mark detecting position Pc, the third mark detector 33 detects the position of the mark 29 applied to the film 9 and the position of the edge 91 in the width direction intermittently at tiny intervals of time. By doing so, the third mark detector 33 acquires a detection signal indicating chronological change in the position of the mark 29 in the width direction relative to the edge 91 occurring at the third mark detecting position Pc. Then, the third mark detector 33 outputs the acquired detection signal to the controller 40.

At the fourth mark detecting position Pd, the fourth mark detector 34 detects the position of the mark 29 applied to the film 9 and the position of the edge 91 in the width direction intermittently at tiny intervals of time. By doing so, the fourth mark detector 34 acquires a detection signal indicating chronological change in the position of the mark 29 in the width direction relative to the edge 91 occurring at the fourth mark detecting position Pd. Then, the fourth mark detector 34 outputs the acquired detection signal to the controller 40.

The configuration of a control system in the image recording apparatus 1 will be described next by mainly referring to FIGS. 1 and 5.

The controller 40 is means for controlling the motion of each part in the image recording apparatus 1. As conceptually shown in FIG. 1, the controller 40 is configured using a computer including a processor 401 such as a CPU, a memory 402 such as a RAM, and a storage 403 such as a hard disk drive. The storage 403 contains a computer program CP for implementation of a printing process. As indicated by dashed lines in FIG. 1, the controller 40 is electrically connected to each of the foregoing transport mechanism 10, four recording heads 21 to 24, and three mark detectors 31 to 34. The controller 40 controls the motion of each of these units by following the computer program CP. This causes the hardware and the software described above to work cooperatively to proceed with a printing process in the image recording apparatus 1.

The controller 40 of this embodiment performs control of adjusting the printing process appropriately by considering positional deviation of the film 9 in the transport direction. More specifically, at the time of implementation of the printing process, the controller 40 acquires information about the mark 29 applied by the first recording head 21 as a mark applicator and detection signals (detection result) acquired by the mark detectors 31 to 34. On the basis of these pieces of information, the controller 40 calculates (detects) a transport speed of the film 9, the amount of positional deviation of the film 9 in the transport direction, and tension on the film 9 applied in the transport direction. On the basis of a result of this calculation, the controller 40 corrects timing of ejection of ink droplets from the four recording heads 21 to 24. By doing so, the foregoing misregistration in the transport direction is suppressed.

Figure 5:
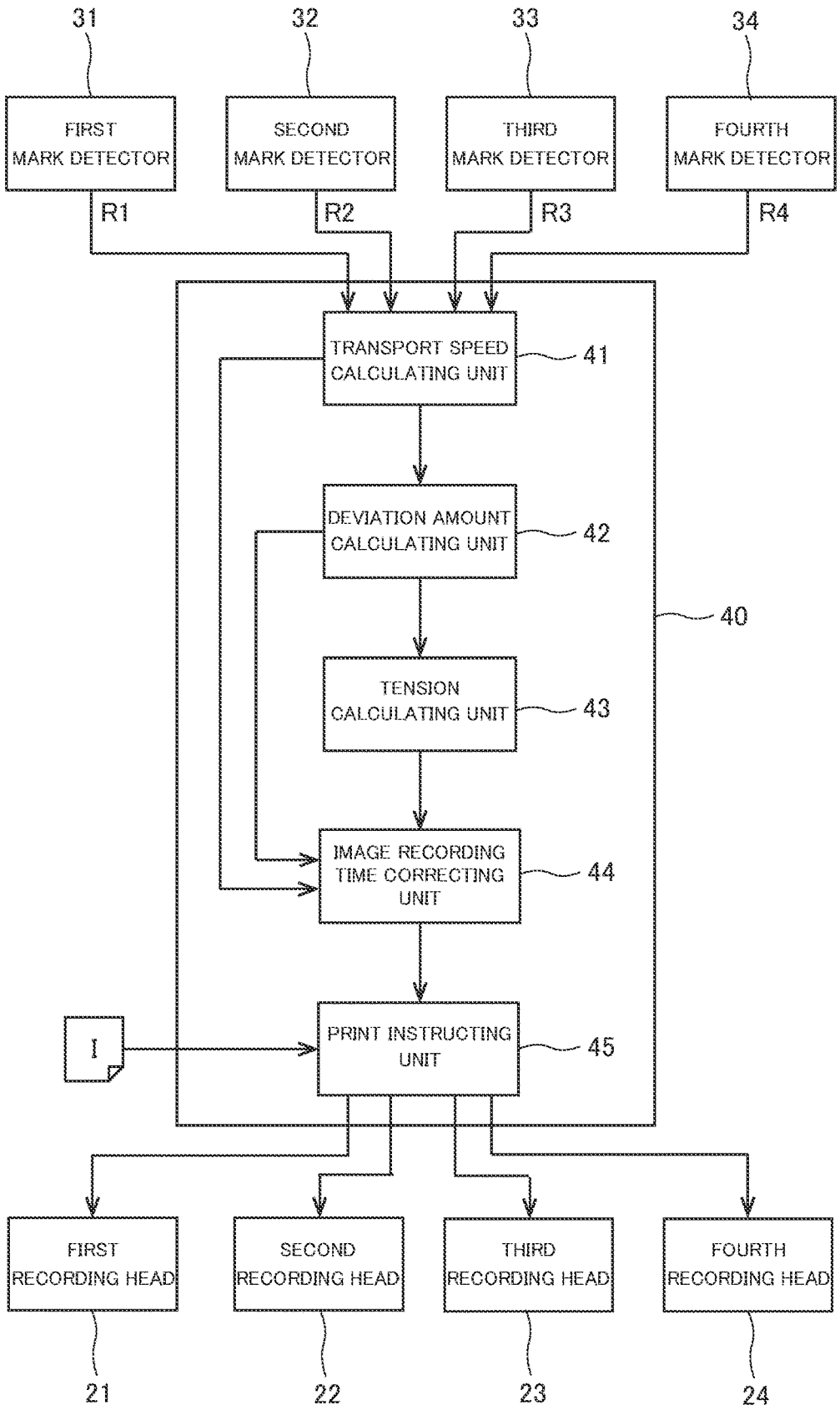
FIG. 5 is a block diagram conceptually showing functions in a controller according to the first embodiment.

FIG. 5 is a block diagram conceptually showing functions in the controller 40 for realizing the detecting and correcting processes described above. As shown in FIG. 5, the controller 40 includes a transport speed calculating unit (calculating unit) 41, a deviation amount calculating unit (calculating unit) 42, a tension calculating unit (calculating unit) 43, an image recording time correcting unit 44, and a print instructing unit 45. These functions of the controller 40 are realized by causing the processor 401 to operate on the basis of the computer program CP.

Figure 6:
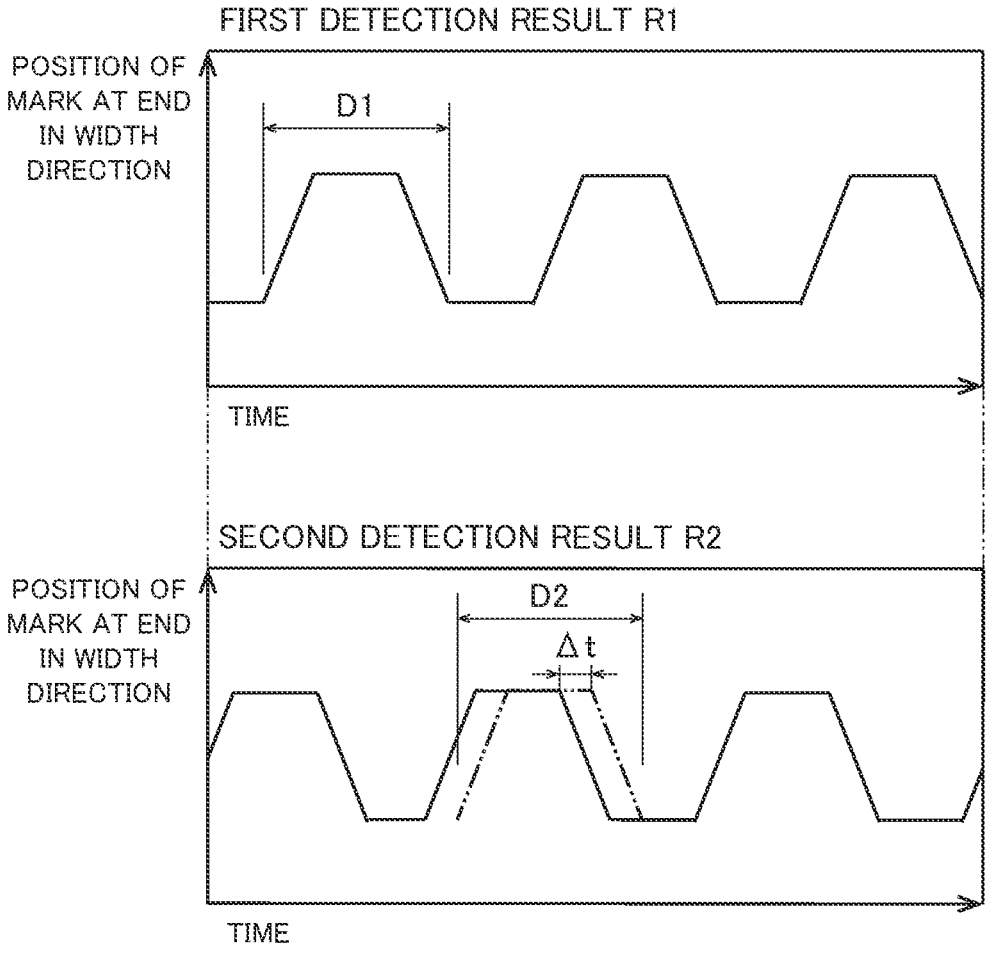
FIG. 6 is a graph showing an exemplary first detection result and an exemplary second detection result according to the first embodiment.

The transport speed calculating unit 41 detects a transport speed of the film 9 between the first mark detector 31 and the second mark detector 32 on the basis of a first detection result R1 acquired from the first mark detector 31 and a second detection result R2 acquired from the second mark detector 32. FIG. 6 is a graph showing an example of the first detection result R1 and an example of the second detection result R2. In the graph of FIG. 6, the horizontal axis indicates time and the vertical axis indicates a distance of the mark 29 in the width direction from the edge 91. The first detection result R1 is data reflecting the shape of the mark 29 on the film 9 while the mark 29 passes through the first mark detecting position Pa. The second detection result R2 is data reflecting the shape of the mark 29 on the film 9 while the mark 29 passes through the second mark detecting position Pb.

As processes including printing are performed sequentially on the film 9 while the film 9 is transported by the transport mechanism 10, or as a result of the motion of each part such as a roller forming the transport mechanism 10, a transport speed of the film 9 may be changed in a part. This causes deviation of timing of detection of the mark 29 by a tiny period of time detected by each of the mark detectors 31 to 34. The transport speed calculating unit 41 acquires such tiny deviation of timing of detection of the mark 29, thereby calculating a transport speed of the film 9 between adjacent mark detectors.

More specifically, the transport speed calculating unit 41 refers to a certain data section (certain time range) in the first detection result R1. Then, the transport speed calculating unit 41 refers to a corresponding data section in the second detection result R2 in which data same as data in the certain data section is expected to be acquired on condition that the film 9 is transported at an ideal transport speed. In the following, the foregoing certain data section in the first detection result R1 will be called a comparison source data section D1. The corresponding data section in the second detection result R2 will be called a comparison target data section D2.

The transport speed calculating unit 41 compares a shape in the comparison source data section D1 and a shape in the comparison target data section D2 using a publicly-known matching technique such as cross-correlation or residual sum of squares. Then, the transport speed calculating unit 41 determines a time difference Δt between time when the mark 29 of a shape same as the shape in the comparison source data section D1 is expected to be acquired on condition that the film 9 is transported at the ideal transport speed and time when the mark 29 of the same shape is actually acquired in the comparison target data section D2. On the basis of the determined time difference Δt, the transport speed calculating unit 41 calculates a period of time during which the film 9 is actually transported from the first mark detecting position Pa to the second mark detecting position Pb. On the basis of the calculated transport period of time, the transport speed calculating unit 41 calculates a transport speed v1 at which the film 9 is actually transported in a section from the first mark detecting position Pa to the second mark detecting position Pb.

The transport speed calculating unit 41 calculates a transport speed v2 at which the film 9 is actually transported in a section from the second mark detecting position Pb to the third mark detecting position Pc by the same method as that described above. Also, the transport speed calculating unit 41 calculates a transport speed v3 at which the film 9 is actually transported in a section from the third mark detecting position Pc to the fourth mark detecting position Pd.

The transport speed calculating unit 41 acquires information about the shape (phase, for example) of the mark 29, information about time when the mark 29 is applied, and others from the first recording head 21. The transport speed calculating unit 41 compares such information about the mark 29 and the first detection result R1, thereby estimating a transport speed v0 at which the film 9 is actually transported on an upstream side from the first mark detecting position Pa.

FIG. 5 will be referred to again. On the basis of the transport speed v1 calculated by the transport speed calculating unit 41, the deviation amount calculating unit 42 calculates time when each part of the film 9 is to reach the second processing position P2. By doing so, the amount of positional deviation of the film 9 in the transport direction occurring at the second processing position P2 is calculated, relative to a case where the film 9 is transported at the ideal transport speed. This positional deviation amount is calculated by multiplying a difference, which is between time when the film 9 is expected to reach the second processing position P2 on condition that the film 9 is transported at the ideal speed and time when the film 9 actually reaches the second processing position P2, by the actual transport speed v1.

The deviation amount calculating unit 42 calculates the amount of positional deviation of the film 9 in the transport direction occurring at the third processing position P3 by the same method as that described above. Also, the deviation amount calculating unit 42 calculates the amount of positional deviation of the film 9 in the transport direction occurring at the fourth processing position P4. Further, the deviation amount calculating unit 42 calculates the amount of positional deviation of the film 9 in the transport direction occurring at the first processing position P1 on the basis of the information about the mark 29 acquired from the first recording head 21 and the transport speed v0. This positional deviation amount at the first processing position P1 can be regarded as zero.

The tension calculating unit 43 assumes that the film 9 has a constant Young's modulus, and gives consideration to the amount of expansion of the film 9 in the transport direction, thereby calculating tension on the film 9 applied in the transport direction at each of the processing positions P1 to P4. More specifically, on the basis of the deviation amount at each of the processing positions P1 to P4 calculated by the deviation amount calculating unit 42, the tension calculating unit 43 determines the amount of expansion with deviation toward a downstream side of the transport direction expressed as a positive value, and multiplies the determined amount of expansion by the Young's modulus of the film 9. A result thereof is calculated as tension.

On the basis of the transport speed calculated by the transport speed calculating unit 41, the positional deviation amount calculated by the deviation amount calculating unit 42, and the tension calculated by the tension calculating unit 43, the image recording time correcting unit 44 corrects timing of ejection of ink droplets from each of the recording heads 21 to 24. As an example, if a part of the film 9 intended for image recording is to reach each of the processing positions P1 to P4 at time later than ideal time, the image recording time correcting unit 44 delays timing of ejection of ink droplets from each of the recording heads 21 to 24. If a part of the film 9 intended for image recording is to reach each of the processing positions P1 to P4 at time earlier than ideal time, the image recording time correcting unit 44 advances timing of ejection of ink droplets from each of the recording heads 21 to 24.

On the basis of input image data I, the print instructing unit 45 controls motion of ejecting ink droplets from each of the recording heads 21 to 24. At this time, the print instructing unit 45 refers to a correction value about ejection timing output from the image recording time correcting unit 44. Then, the print instructing unit 45 follows this correction value to shift original ejection timing based on the image data I. By doing so, at each of the processing positions P1 to P4, ink droplets of a corresponding color are ejected to a proper place on the film 9 in the transport direction. This suppresses positional deviation in the transport direction between single-color images formed using the respective colors. As a result, color matching is done properly, making it possible to obtain a high-quality printed matter with little misregistration.

As described above, the image recording apparatus 1 of this embodiment includes the mark detector 30 that acquires a detection result by continuously detecting the mark 29 at the mark detecting positions Pa to Pd on the transport path applied previously to the end of the film 9 in the width direction on an upstream side. The image recording apparatus 1 further includes the calculating units 41, 42, and 43 that calculate a transport speed and others of the film 9 on the basis of the detection result acquired by the mark detector 30 and information about the mark 29 applied previously to the film 9. Thus, even if a base material such as the film 9 does not have a characteristic shape at an end thereof in the width direction, it is still possible to acquire information such as a transport speed using the mark 29 applied previously and intentionally to the end of the base material in the width direction.

The image recording apparatus 1 of this embodiment includes the first recording head 21 as a mark applicator that applies the mark 29 at a mark applying position (first processing position) P1 upstream of the transport path from the mark detecting positions Pa to Pd to the end of the film 9 in the width direction. This makes it possible to acquire information such as a transport speed of the film 9 specifically through comparison between information about the mark 29 applied by the first recording head 21 and the detection result obtained by the mark detector 30.

The image recording apparatus 1 of this embodiment includes the plurality of mark detectors 31 to 34. By comparing a detection result from the mark detector 31 of the plurality of mark detectors 31 to 34 and a detection result from the mark detector 32 downstream of the transport direction from the mark detector 31, calculation is made to determine a transport speed and others of the film 9. Thus, even if the mark 29 applied by the first recording head 21 does not conform to an intention, it is still possible to determine a transport speed and others of the film 9 with high accuracy through comparison between results obtained by detecting the same mark 29 at the mark detecting positions Pa to Pd defined at a plurality of places in the transport direction.

In this embodiment, the mark 29 is a continuous pattern. This allows the mark 29 to be detected stably and uninterruptedly. Specifically, this allows calculation of a transport speed and others more correctly and more reliably than in a configuration where a mark is formed as intermittent spots, for example, and calculation is made to determine a transport speed and others by counting the number of times these spots (markers) passed through a mark detector. Further, making the mark detector 30 monitor the continuous shape of the mark 29 allows grasping of information such as expansion and contraction of the film 9 in the transport direction more easily.

In the image recording apparatus 1 of this embodiment, the mark applicator is a processing unit that performs a process (recording of an image) on a surface of the film 9. This allows application of the mark 29 along with implementation of the process on the surface of the film 9, thereby allowing the image recording apparatus 1 to operate with no waste.

In the image recording apparatus 1 of this embodiment, the processing unit is the first recording head (image recording unit) 21 that makes a print on the surface of the film 9. This allows recording of the mark 29 by printing. This makes it possible to prevent the occurrence of a broken piece of the film 9, for example, during application of the mark 29. This further facilitates formation of the mark 29 into a complicated pattern.

In the image recording apparatus 1 of this embodiment, timing of ejection of ink from the image recording unit 20 is corrected on the basis of a calculation result including positional deviation of the film 9 in the transport direction (see FIG. 5). This allows timing of ejection of ink to be adjusted in consideration of the amount of positional deviation of the film 9 in the transport direction and others. As a result, the ejected ink is located at a more appropriate position on the film 9.

The base material used in the image recording apparatus 1 of this embodiment is described as a transparent film. Generally, a characteristic shape at an end in a width direction is hard to find and an edge is hard to detect in a base material such as a transparent film if the base material is used as it is. In this regard, the mark 29 is applied intentionally to the end of the film 9 in the width direction in this embodiment, thereby allowing calculation of a transport speed and others of the film 9.

In the image recording apparatus 1 of this embodiment, the mark detector 30 includes the phototransmitter 301 and the line sensor 302. This produces a large difference between the quantity of light received on the back side of a place in the presence of the applied mark 29 and the quantity of light received on the back side of a place in the absence of the applied mark 29. This allows the mark 29 to be detected easily.

2. Second Embodiment

An image recording apparatus 2 according to a second embodiment of the present invention will be described next by referring to FIGS. 7 to 10. In the following, differences from the first embodiment will mainly be described, and a member or a mechanism comparable to that of the first embodiment will be given the same sign to omit explanation of such a member or a mechanism overlapping between the embodiments.

The image recording apparatus 2 according to the second embodiment differs from the image recording apparatus 1 according to the first embodiment in that, instead of making only the first recording head 21 further function as a mark applicator, the four recording heads 21 to 24 further function as first to fourth mark applicators respectively. The image recording apparatus 2 also differs from the image recording apparatus 1 in that it includes one mark detector 35 instead of the four mark detectors 31 to 34 described in the first embodiment.

Figure 9:
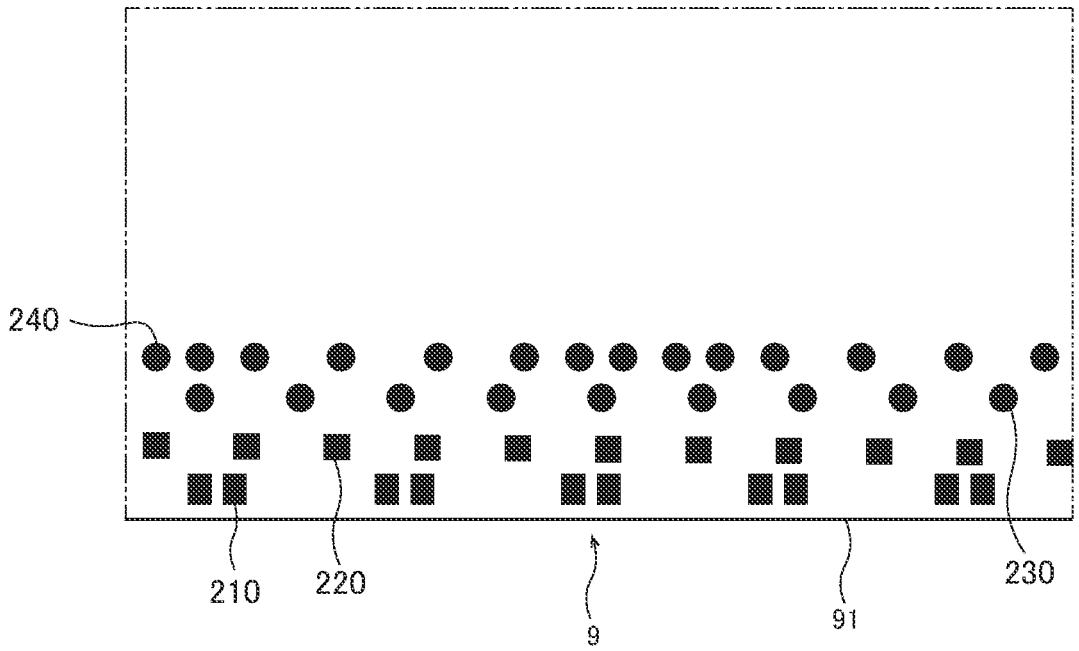
FIG. 9 is a view showing exemplary first to fourth marks applied to an end of a base material in a width direction thereof by a mark applicator according to the second embodiment.

The first recording head 21 according to this embodiment further functions as the first mark applicator. The first recording head 21 applies a first mark 210 by printing to an end of the film 9 in the width direction. FIG. 9 shows the form of the first mark 210 according to this embodiment. As shown in FIG. 9, the first mark 210 has a pattern with intermittent and periodic spots or dots.

The second recording head 22 according to this embodiment further functions as the second mark applicator. The second recording head 22 applies a second mark 220 by printing to a position different from the first mark 210 in the width direction at the end of the film 9 in the width direction. FIG. 9 shows the form of the second mark 220 according to this embodiment. As shown in FIG. 9, the second mark 220 has a pattern with intermittent and periodic spots or dots.

The third recording head 23 according to this embodiment further functions as the third mark applicator. The third recording head 23 applies a third mark 230 by printing to a position different from both the first mark 210 and the second mark 220 in the width direction at the end of the film 9 in the width direction. As shown in FIG. 9, the third mark 230 has a pattern with intermittent and periodic spots or dots.

The fourth recording head 24 according to this embodiment further functions as the fourth mark applicator. The fourth recording head 24 applies a fourth mark 240 by printing to a position different from each of the first mark 210, the second mark 220, and the third mark 230 in the width direction at the end of the film 9 in the width direction. As shown in FIG. 9, the fourth mark 240 has a pattern with intermittent and periodic spots or dots.

Figure 7:
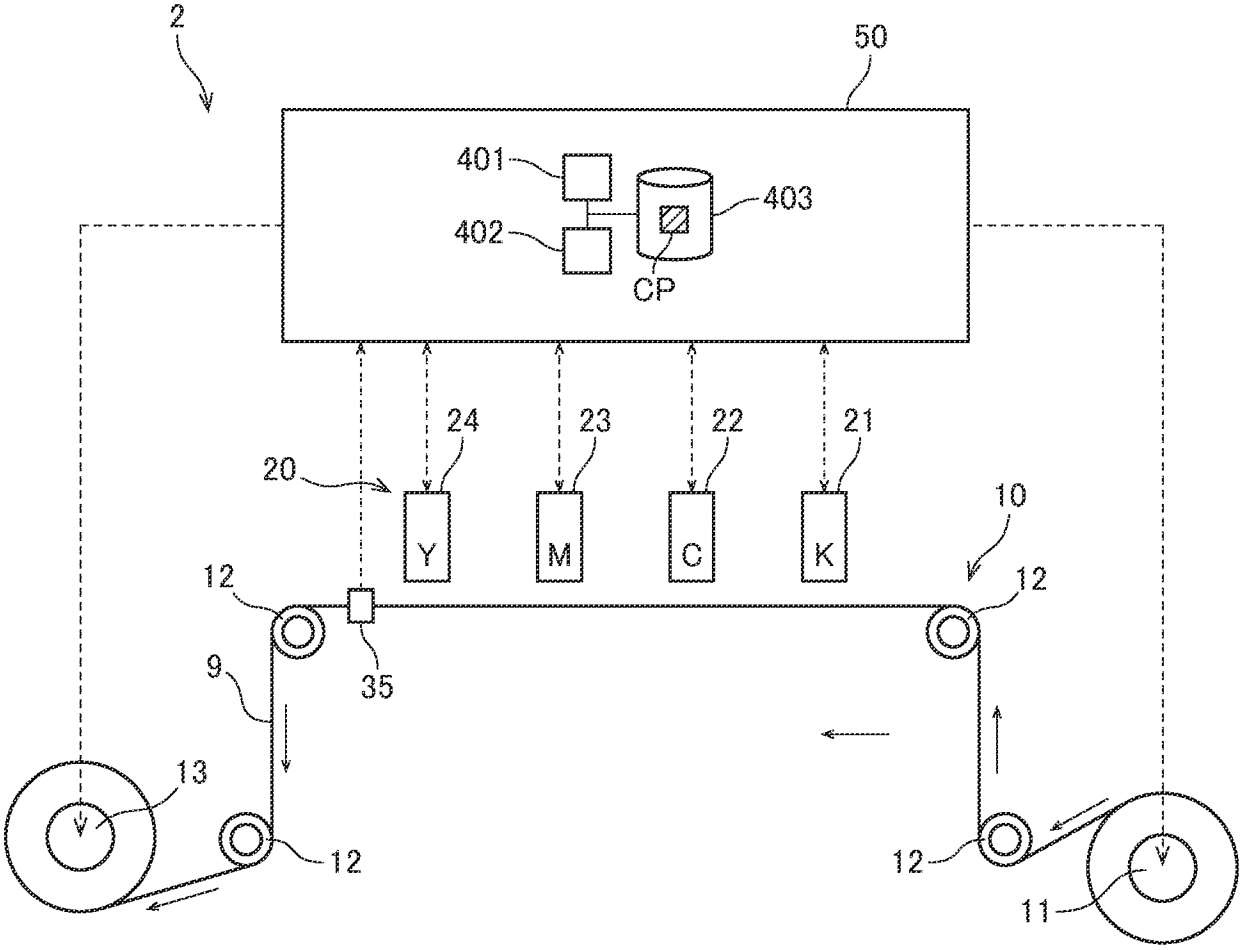
FIG. 7 is a view showing an entire configuration of a base material processing apparatus according to a second embodiment.
Figure 8:
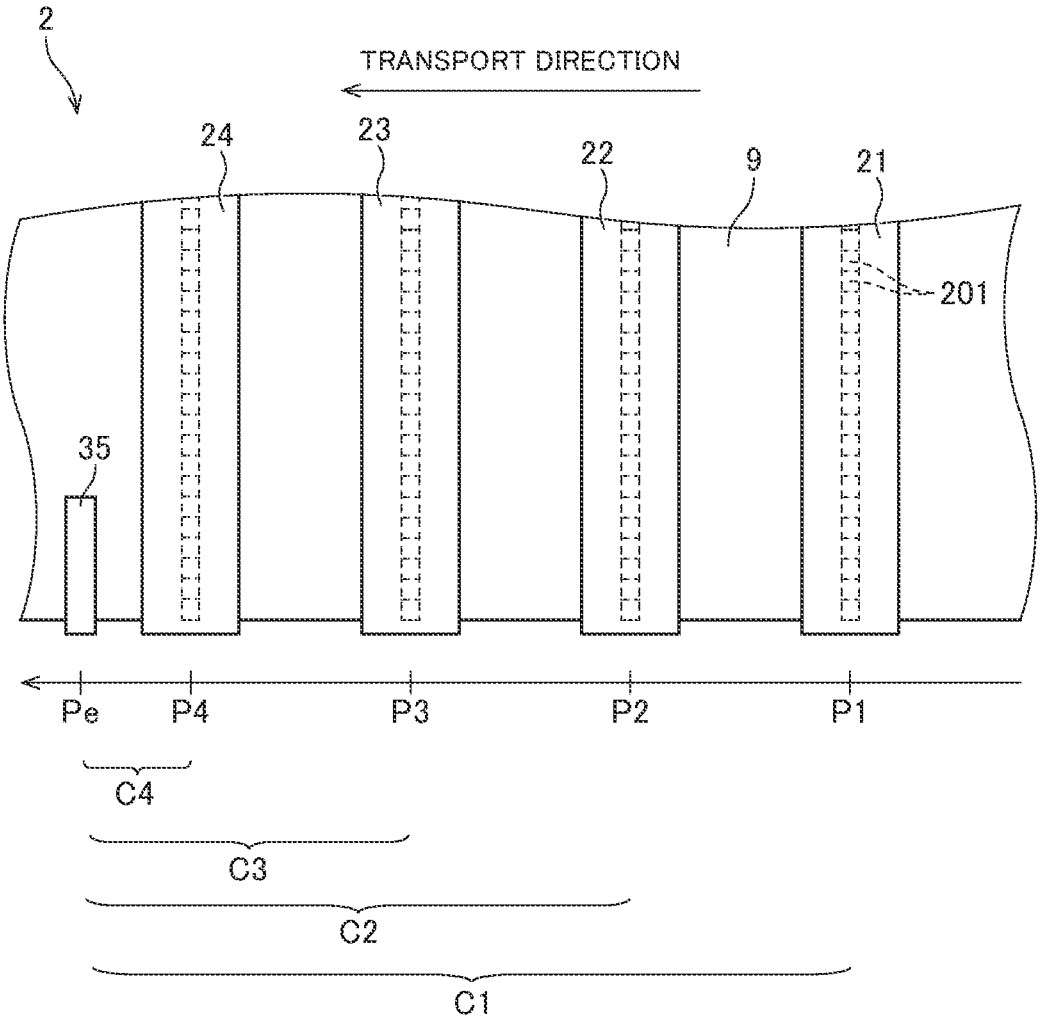
FIG. 8 is a partial top view of the base material processing apparatus according to the second embodiment taken at a processing unit and its vicinity.

The mark detector 35 will be described next by referring to FIGS. 7 and 8. The mark detector 35 of this embodiment detects the first mark 210, the second mark 220, the third mark 230, and the fourth mark 240 distinctively from each other at a detecting position Pe downstream of a transport path from the first to fourth recording heads 21 to 24 as the first to fourth mark applicators respectively. Like the mark detector 30 according to the first embodiment, the mark detector 35 is configured using the phototransmitter 301 and the line sensor 302. At the detecting position Pe, the mark detector 35 continuously detects the first to fourth marks 210 to 240 applied to the film. At this time, as the first to fourth marks 210 to 240 are applied to the positions in the width direction different from each other, the mark detector 35 is allowed to easily detect all the marks 210 to 240 distinctively from each other. The mark detector 35 outputs respective resultant detection signals about the marks 210 to 240 to a controller 40.

Figure 10:
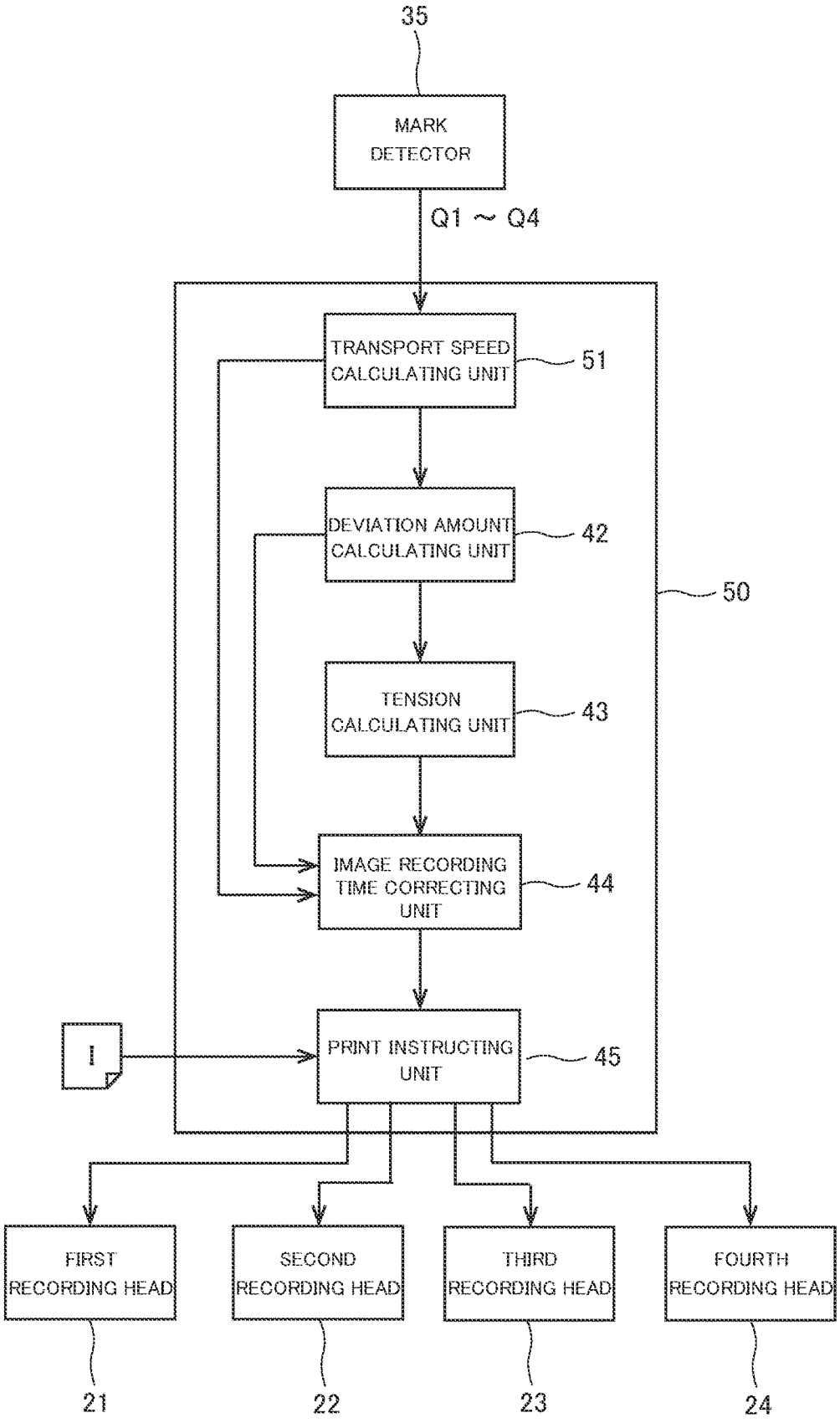
FIG. 10 is a block diagram conceptually showing functions in a controller according to the second embodiment.

The configuration of a control system in the image recording apparatus 2 will be described next by mainly referring to FIGS. 7 and 10. FIG. 10 conceptually shows functions in the controller 50 of this embodiment.

Like the controller 40 according to the first embodiment, the controller 50 of this embodiment is configured using a computer. As shown in FIG. 7, the controller 50 is electrically connected to each of the transport mechanism 10, the four recording heads 21 to 24, and the mark detector 35. The controller 50 controls the motion of each of these units by following a computer program CP.

As shown in FIG. 10, the controller 50 includes a transport speed calculating unit 51, the deviation amount calculating unit 42, the tension calculating unit 43, the image recording time correcting unit 44, and the print instructing unit 45. These functions of the controller 50 are realized by causing the processor 401 to operate on the basis of the computer program CP.

On the basis of information about the fourth mark 240 acquired from the fourth recording head 24 and a fourth detection result Q4 about the fourth mark 240 acquired by the detector 35, the transport speed calculating unit 51 detects a transport speed C4 at which the film 9 is transported between the fourth processing position P4 and the detecting position Pe. More specifically, the transport speed calculating unit 51 determines a time difference Δt between time when a part of the fourth mark 240 is expected to be acquired by the mark detector 35 on condition that the film 9 is transported at an ideal transport speed and time when this part of the fourth mark 240 is actually detected by the mark detector 35. On the basis of the determined time difference Δt, the transport speed calculating unit 51 calculates a period of time during which the film 9 is actually transported from the fourth processing position P4 to the detecting position Pe. On the basis of the calculated transport period of time, the transport speed calculating unit 51 calculates a transport speed C4 at which the film 9 is actually transported in a section from the fourth processing position P4 to the detecting position Pe.

The transport speed calculating unit 51 calculates a transport speed C3 at which the film 9 is actually transported in a section from the third processing position P3 to the mark detecting position Pe by the same method as that described above. Then, on the basis of a difference between the transport speed C4 and the transport speed C3, the transport speed calculating unit 51 estimates a transport speed at which the film 9 is actually transported in a section from the third processing position P3 to the fourth processing position P4.

The transport speed calculating unit 51 estimates a transport speed C2 at which the film 9 is actually transported in a section from the second processing position P2 to the third processing position P3 by the same method as that described above. Then, on the basis of a difference between the transport speed C3 and the transport speed C2, the transport speed calculating unit 51 estimates a transport speed at which the film 9 is actually transported in a section from the second processing position P2 to the third processing position P3. Also, the transport speed calculating unit 51 estimates a transport speed C1 at which the film 9 is actually transported in a section from the first processing position P1 to the second processing position P2. Then, on the basis of a difference between the transport speed C2 and the transport speed C1, the transport speed calculating unit 51 estimates a transport speed at which the film 9 is actually transported in a section from the first processing position P1 to the second processing position P2. In addition to these, the transport speed calculating unit 51 may estimate a transport speed at which the film 9 is actually transported on an upstream side of the transport direction from the first processing position P1.

The deviation amount calculating unit 42 calculates the amount of positional deviation of the film 9 in the transport direction occurring at each of the processing positions P1 to P4 using the calculation result obtained by the transport speed calculating unit 51. The tension calculating unit 43 calculates tension on the film 9 applied in the transport direction at each of the processing positions P1 to P4.

The calculation result obtained by the transport speed calculating unit 51, the deviation amount calculating unit 42, and the tension calculating unit 43 are input to the image recording time correcting unit 44. On the basis of these calculation result, the image recording time correcting unit 44 calculates a correction value about ejection timing to be given to the four recording heads 21 to 24. By referring to this correction value about ejection timing and on the basis of input image data I, the print instructing unit 45 controls motion of ejecting ink droplets from each of the recording heads 21 to 24. This suppresses positional deviation in the transport direction between single-color images formed using the respective colors. As a result, a high-quality printed matter with little misregistration is also obtained in this embodiment.

As described above, in the image recording apparatus 2 of this embodiment, the transport speeds C1, C2, C3, and C4 of the film 9 are calculated on the basis of the marks 210 to 240 applied by the recording heads 21 to 24 respectively, and the calculated transport speeds are compared. This makes it possible to determine a degree of change in a transport speed between recording heads adjacent to each other in the transport direction, the amount of positional deviation in the transport direction occurring in this section, a degree of change in tension occurring in this section, and others.

The image recording apparatus 2 of this embodiment includes the image recording time correcting unit 44 that corrects timing of ejection of ink from each of the recording heads 21 to 24 on the basis of a calculation result such as the amount of positional deviation of the film 9 in the transport direction. This allows timing of ejection of ink to be adjusted in consideration of the amount of positional deviation occurring between recording heads adjacent to each other in the transport direction and others. As a result, color matching can be done with high accuracy, making it possible to reduce the occurrence of misregistration in the transport direction.

3. Third Embodiment

An image recording apparatus 3 according to a third embodiment of the present invention will be described next by referring to FIGS. 11 to 16. In the following, differences from the first embodiment and the second embodiment will mainly be described, and a member or a mechanism comparable to that of the first embodiment and the second embodiment will be given the same sign to omit explanation of such a member or a mechanism overlapping between the embodiments.

The image recording apparatus 3 according to the third embodiment differs from the image recording apparatus 1 according to the first embodiment in that a base material to be transported is opaque elongated strip-shaped printing paper 90. The image recording apparatus 3 further differs from the image recording apparatus 1 according to the first embodiment in that, instead of making the first recording head 21 function as a mark applicator, a mark applicator 26 arranged upstream of the transport direction from the first recording head 21 applies the mark 28. The image recording apparatus 3 still differs from the image recording apparatus 1 according to the first embodiment in that it includes four edge detectors 71 to 74 provided at the mark detecting positions Pa to Pd respectively instead of the four mark detectors 31 to 34. The mark applicator 26 is provided at a mark applying position Pf upstream of the transport direction from the mark detecting position Pa.

Figure 13:
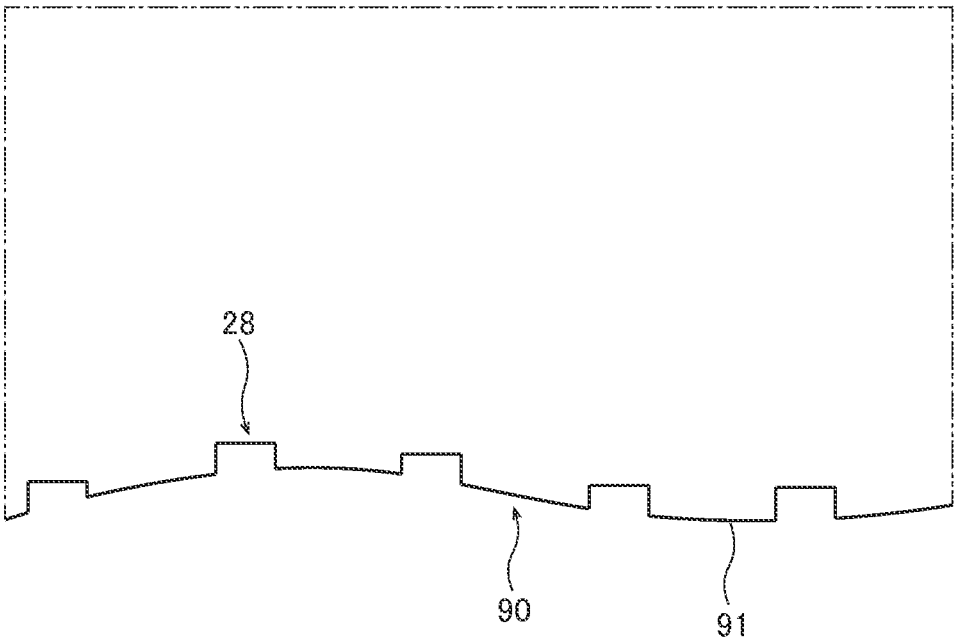
FIG. 13 is a view showing an exemplary mark applied to an end of a base material in a width direction thereof by a mark applicator according to the third embodiment.

The mark applicator 26 of this embodiment is a cutter that applies the mark 28 by cutting an end of the printing paper 90 in the width direction. In another way of saying, the mark applicator 26 applies the mark 28 to the end of the printing paper 90 in the width direction by cutting out a cutout piece of a particular shape from this end. FIG. 13 shows the form of the mark 28 according to this embodiment. As shown in FIG. 13, the mark 28 has a pattern with intermittent and periodic substantially rectangular spots.

Figure 14:
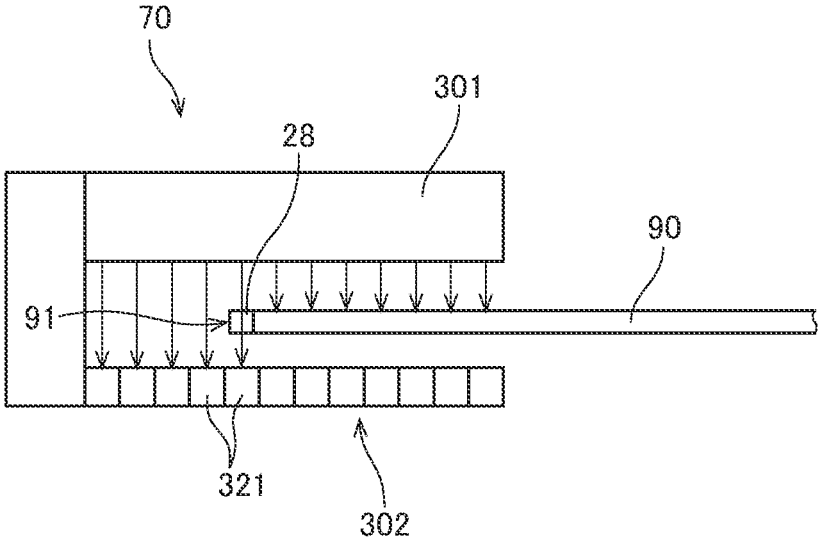
FIG. 14 is a view schematically showing the configuration of a mark detector according to the third embodiment.

The four edge detectors (edge sensors) 71 to 74 are mark detectors according to this embodiment. As shown in FIG. 14, like the mark detector 30 according to the first embodiment, each of the four edge detectors 70 is configured using the phototransmitter 301 and the line sensor 302. As shown in FIG. 14, at a place of the printing paper 90 inside the edge 91 in the width direction, light emitted from the phototransmitter 301 is blocked by the printing paper 90. Thus, the light-receiving elements 321 do not detect the light. At a place of the printing paper 90 outside the edge 91 in the width direction, light emitted from the phototransmitter 301 is detected as it is by the light-receiving elements 321. On the basis of the quantities of light detected in this way by the plurality of light-receiving elements 321, the edge detectors 71 to 74 detect the position of the edge 91 of the printing paper 90 and the position of the mark 28 in the width direction.

The four edge detectors 71 to 74 detect the position of the edge 91 (mark 28) of the printing paper 90 in the width direction intermittently at tiny intervals of time at the mark detecting positions Pa to Pd respectively. By doing so, the edge detectors 71 to 74 acquire detection signals indicating chronological change in the position of the edge 91 in the width direction. Then, the edge detectors 71 to 74 output the acquired detection signals to a controller 60.

Figure 11:
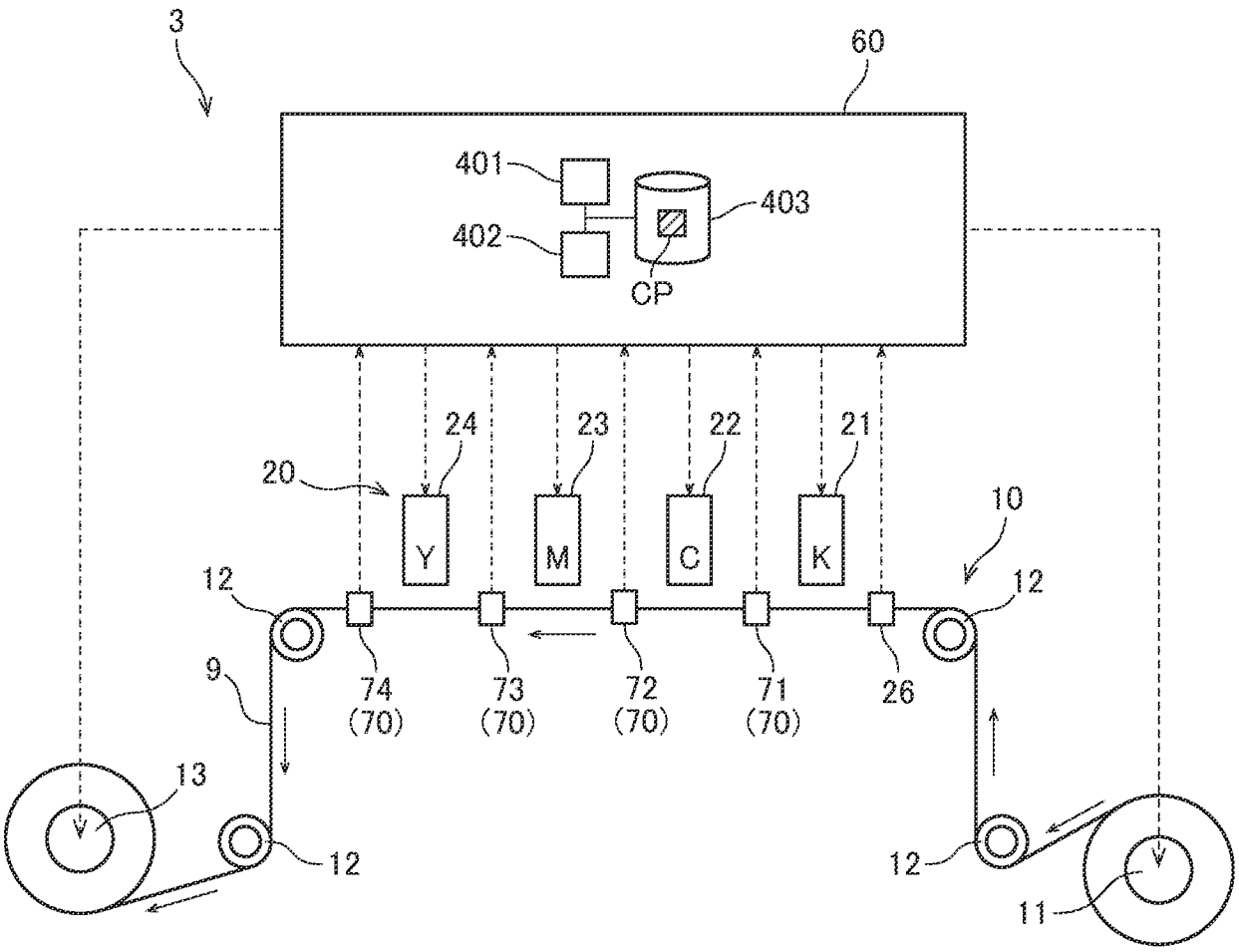
FIG. 11 is a view showing an entire configuration of a base material processing apparatus according to a third embodiment.
Figure 12:
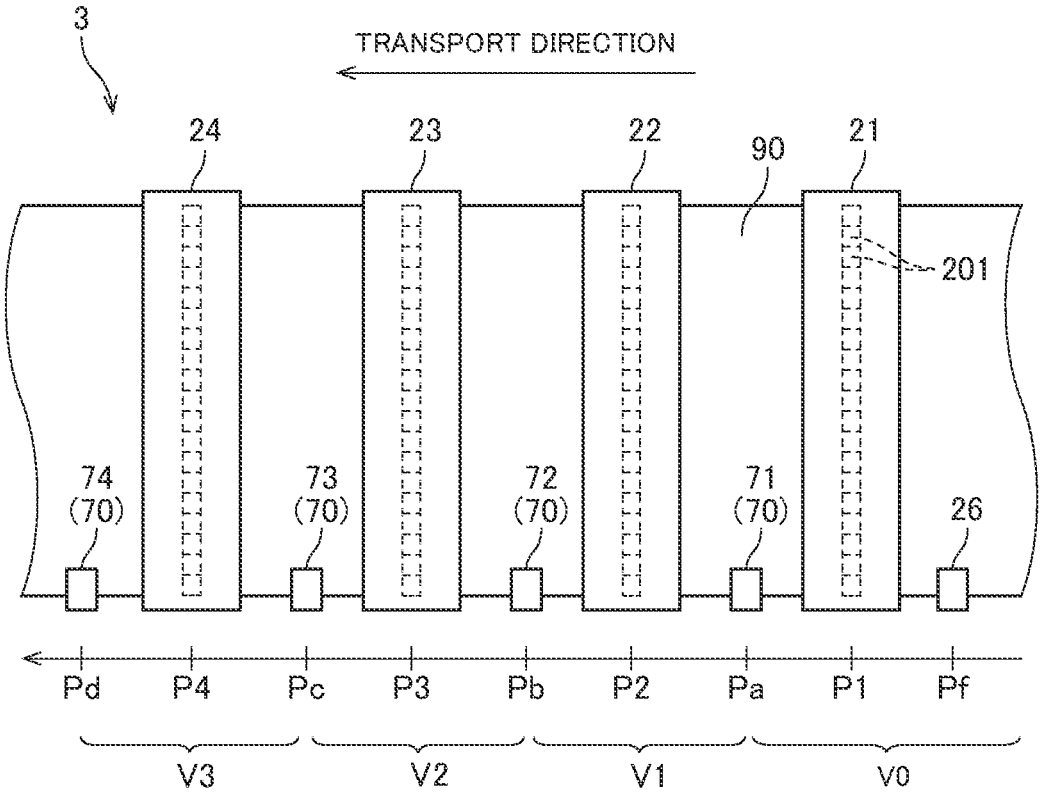
FIG. 12 is a partial top view of the base material processing apparatus according to the third embodiment taken at a processing unit and its vicinity.
Figure 15:
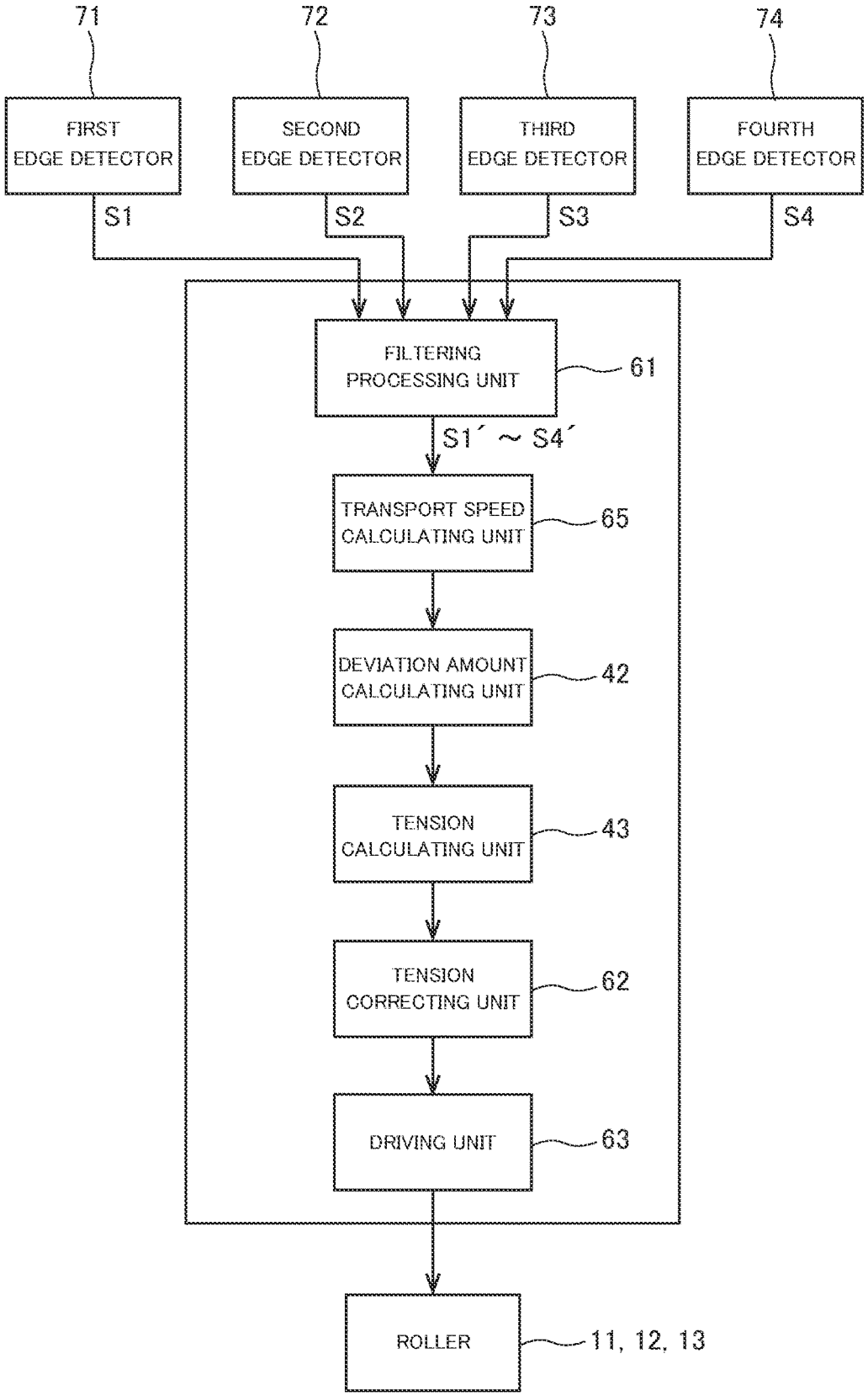
FIG. 15 is a block diagram conceptually showing functions in a controller according to the third embodiment.

The configuration of a control system in the image recording apparatus 3 will be described next by mainly referring to FIGS. 11 and 15. FIG. 15 conceptually shows functions in the controller 60 of this embodiment.

Like the controller 40 according to the first embodiment, the controller 60 of this embodiment is configured using a computer. As shown in FIG. 11, the controller 60 is electrically connected to each of the transport mechanism 10, the four recording heads 21 to 24, the mark applicator 26, and the four edge detectors 71 to 74. The controller 60 controls the motion of each of these units by following a computer program CP.

As shown in FIG. 15, the controller 60 includes a filtering processing unit 61, a transport speed calculating unit 65, the deviation amount calculating unit 42, the tension calculating unit 43, a tension correcting unit 62, and a driving unit 63. The tension correcting unit 62 and the driving unit 63 together function as a transport motion correcting unit according to this embodiment. These functions of the controller 60 are realized by causing the processor 401 to operate on the basis of the computer program CP.

The filtering processing unit 61 performs a filtering process for removing a noise signal on each of a first detection result S1 obtained from the first edge detector 71, a second detection result S2 obtained from the second edge detector 72, a third detection result S3 obtained from the third edge detector 73, and a fourth detection result S4 obtained from the fourth edge detector 74. Specifically, the first detection result S1 contains information such as fluctuations of the position of the edge 91 in the width direction resulting from serpentine motion of the printing paper 90 or fluctuations of the position of the edge 91 in the width direction resulting from warpage of the printing paper 90. In order to remove such unnecessary signals and allow a signal resulting from the mark 28 as a detection target to be detected fully, the filtering processing unit 61 of this embodiment removes a low-frequency signal. Various publicly-known methods are applicable to this filtering process. For example, discrete Fourier transform or Walsh transform may be used.

Figure 16:
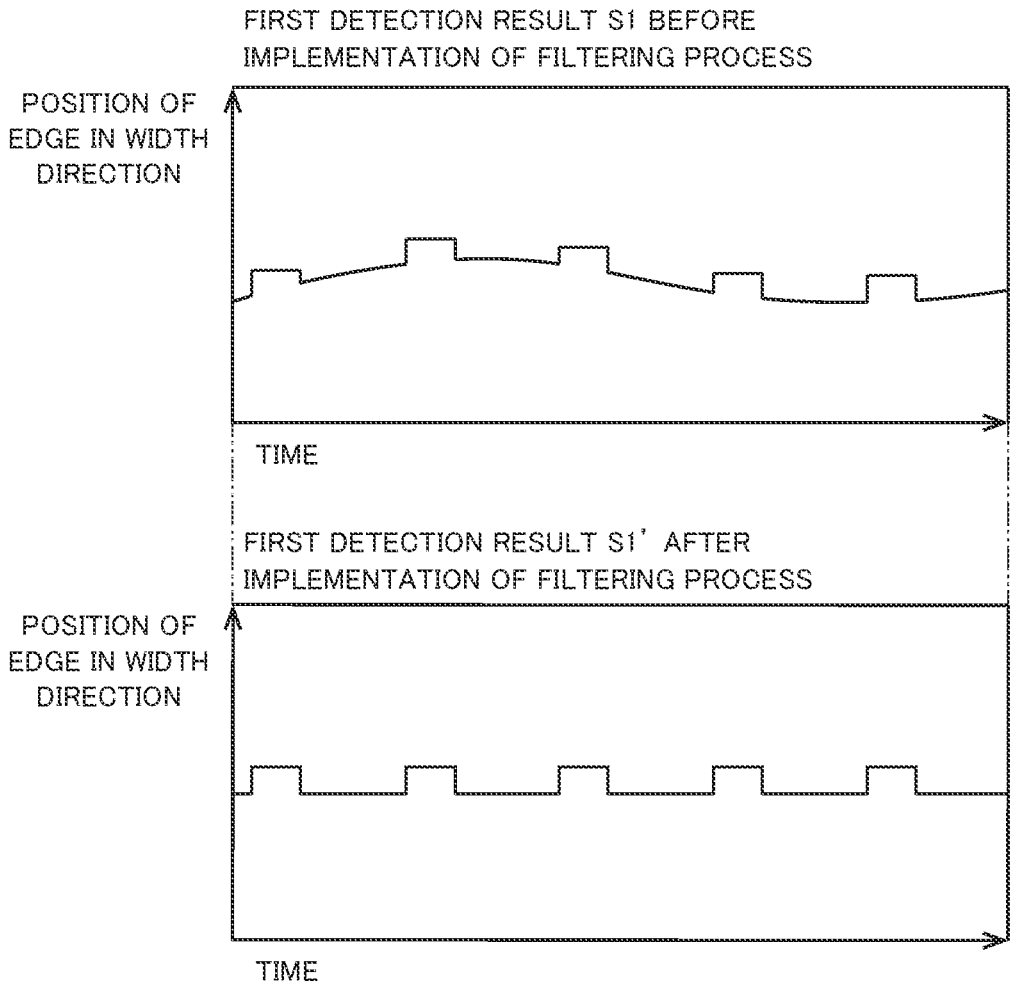
FIG. 16 is a view showing an exemplary first detection result before implementation of a filtering process and an exemplary first detection result after implementation of the filtering process according to the third embodiment.

The upper section of FIG. 16 shows the first detection result S1 before implementation of the filtering process, and the lower section of FIG. 13 shows a first detection result S1' after implementation of the filtering process. In the graph of FIG. 13, the horizontal axis indicates time and the vertical axis indicates the position of the edge 91 (mark 28) in the width direction. As a result of implementation of the foregoing filtering process by the filtering processing unit 61, a signal indicating the mark 28 is given clearly in the first detection result S1'.

The transport speed calculating unit 65 calculates a transport speed at which the printing paper 90 is actually transported in each of the foregoing sections by the same method as that described in the first embodiment. This will be described briefly. The transport speed calculating unit 65 calculates a transport speed V1 at which the printing paper 90 is actually transported in a section from the first mark detecting position Pa to the second mark detecting position Pb by comparing the first detection result S1 and the second detection result S2 (see FIG. 12). The transport speed calculating unit 65 calculates a transport speed V2 at which the printing paper 90 is actually transported in a section from the second mark detecting position Pb to the third mark detecting position Pc by comparing the second detection result S2 and the third detection result S3. The transport speed calculating unit 65 calculates a transport speed V3 at which the printing paper 90 is actually transported in a section from the third mark detecting position Pc to the fourth mark detecting position Pd by comparing the third detection result S3 and the fourth detection result S4. Also, the transport speed calculating unit 65 calculates a transport speed V0 at which the printing paper 90 is actually transported on an upstream side from the first mark detecting position Pa by comparing information about the mark 28 acquired from the mark applicator 26 and the first detection result S1.

FIG. 15 will be referred to again. The deviation amount calculating unit 42 calculates the amount of positional deviation of the printing paper 90 in the transport direction occurring at each of the processing positions P1 to P4 using the calculation result obtained by the transport speed calculating unit 65. The tension calculating unit 43 calculates tension on the printing paper 90 applied in the transport direction at each of the processing positions P1 to P4.

The tension correcting unit 62 acquires information from the tension calculating unit 43 about tension on the printing paper 90 applied in the transport direction at each of the processing positions P1 to P4. Then, to bring tension applied at each of the processing positions P1 to P4 closer to ideal tension, the tension correcting unit 62 calculates a correction value about a rotation number to be given at least to any of the rollers 11, 12, and 13.

The driving unit 63 controls rotary motion of at least any of the rollers 11, 12, and 13 forming the transport mechanism 10 during printing of input image data I. At this time, the driving unit 63 refers to the correction value about tension output from the tension correcting unit 62. Then, the driving unit 63 adjusts the rotation numbers of the rollers 11, 12, and 13 according to the correction value. By doing so, the printing paper 90 is transported under tension of an appropriate level applied at each of the processing positions P1 to P4, and this eventually results in ejection of ink droplets of each color to an appropriate place on the printing paper 90 in the transport direction. As a result, color matching is also done properly in this embodiment, making it possible to obtain a high-quality printed matter with little misregistration.

In the image recording apparatus 3 of this embodiment, the motions of the rollers 11, 12, and 13 of the transport mechanism 10 are corrected on the basis of a calculation result such as the amount of positional deviation of the printing paper 90 in the transport direction. This allows adjustment of the printing paper 90 in terms of a transport speed, tension, and others in consideration of the calculation result such as the amount of positional deviation of the printing paper 90 in the transport direction. Thus, it becomes possible to perform a process such as recording of an image on the printing paper 90 more properly.

As described above, in the image recording apparatus 3 of this embodiment, the mark detector is the edge detector 70 that detects the position of the edge (border) of the printing paper 90 in the width direction intermittently as a signal. The image recording apparatus 3 includes the filtering processing unit 61 that removes a signal in a lower frequency region than a signal resulting from the mark 28 from the signal detected by the edge detector 70. By doing so, the low-frequency signal resulting from serpentine motion or warpage of the printing paper 90 is removed to allow the signal resulting from the mark 28 to be detected with high accuracy.

4. Modifications

While some embodiments of the base material processing apparatus and the base material processing method according to the present invention have been described hereinabove, the present invention is not limited to the foregoing embodiments.

In the foregoing embodiments, the controller of the image recording apparatus is configured to calculate all a transport speed, the amount of position deviation in the transport direction, and tension applied in the transport direction of the base material. However, this is not the limited configuration but the controller may be configured to calculate at least one of these values.

The foregoing description of the embodiments includes the example of adjusting timing of ejection of ink using a calculation result including a transport speed, the amount of positional deviation in the transport direction, and tension applied in the transport direction of the base material, and the example of adjusting the rotation numbers of the rollers 11, 12, and 13 of the transport mechanism 10. However, these are not the only examples but such a calculation result is usable for a different type of control.

In the foregoing embodiments, a mark applied to the end of the base material by the mark applicator is a periodic pattern. Such a periodic pattern may be formed at the end of the base material in the width direction by rotating a blade bent to a predetermined angle, for example. This achieves application of the periodic pattern to the end of the base material at low cost. The pattern of the mark formed at the end of the base material in the width direction is not always required to be a periodic pattern. As an alternative to this, a random pattern may be applied as the mark to the end of the base material in the width direction, for example.

The mark applied to the end of the base material in the width direction by the mark applicator may stick out of the edge 91. Various publicly-known methods are applicable as a method of applying the mark using the mark applicator. As specific examples, a hole or a cutout may be formed by punching, or a scar may be formed at the end of the base material in the width direction using a smooth sliding cutter. If the mark is to be applied to a known position at the end of the base material, the mark may be applied only once instead of being applied repeatedly.

The number of the mark detectors aligned along the transport path is not limited to that described in the foregoing embodiments. As an example, two or three, or five or more mark detectors may be provided along the transport path.

In the foregoing first embodiment and second embodiment, the mark detector is configured to detect the mark continuously. In the foregoing third embodiment, the mark detector is configured to detect the mark intermittently. However, these are not the limited configurations. Specifically, the mark may be detected intermittently in the examples such as the first embodiment and the second embodiment. In another case, the mark may be detected continuously in the example such as the third embodiment.

The mark detector 30 of the foregoing first embodiment is configured to detect the position of the edge 91 of the base material in the width direction by making use of the fact that light emitted from the phototransmitter 301 is reflected diffusely on the edge 91 so a relatively small quantity of the light is detected by the light-receiving elements 321. Such information about the position of the edge 91 in the width direction may also be used for acquiring a serpentine amount of the base material. This eliminates a need to provide a serpentine amount sensor additionally.

The mark at the end of the base material in the width direction is only required to be applied at a position upstream of the transport path from the mark detector. For example, the mark applicator may be provided still upstream from the transport roller 12 that is directly upstream from the image recording unit 20. To be specific, the mark may be applied using a cutter or through punching, for example, at the end of the base material in the width direction in a cutting step of manufacturing the base material. In another way of saying, a certain mark may be applied previously to a predetermined position at the edge of the base material when the base material is cut from a material.

The base material according to the present invention is not limited to those shown in the foregoing embodiments. For example, the base material may be metallic foil.

The mark detecting positions Pa to Pd on the transport path may agree with the processing positions P1 to P4. More specifically, the mark detectors 31 to 34 may be arranged below the recording heads 21 to 24 respectively.

The components described in the foregoing embodiments and in the modifications may be consistently combined together, as appropriate.

REFERENCE SIGNS LIST

1 Image recording apparatus (base material processing apparatus)
10 Transport mechanism
20 Image recording unit
21 First recording head (mark applicator)
22 Second recording head
23 Third recording head
24 Fourth recording head
30 Mark detector
31 First mark detector
32 Second mark detector
33 Third mark detector
34 Fourth mark detector
40 Controller
41 Transport speed calculating unit (calculating unit)
42 Deviation amount calculating unit (calculating unit)
43 Tension calculating unit (calculating unit)
44 Image recording time correcting unit
45 Print instructing unit

The invention claimed is:

1. A base material processing apparatus comprising:
a transport mechanism that transports an elongated strip-shaped base material in a longitudinal direction thereof along a predetermined transport path;
a mark detector that acquires a detection result by detecting a mark continuously or intermittently at a detecting position on said transport path, the mark being applied previously to an end of said base material in a width direction thereof; and
a calculating unit that calculates at least any of a transport speed of said base material, an amount of positional deviation of said base material in a transport direction, and tension on said base material applied in said transport direction on the basis of said detection result and information about said mark applied previously to said base material,
wherein said mark detector is an edge sensor that acquires a position of an edge of said base material in said width direction continuously or intermittently as a signal,
wherein the base material processing apparatus further comprising a filtering processing unit that removes a signal in a lower frequency region than a signal resulting from said mark from said signal detected by said edge sensor.

2. The base material processing apparatus according to claim 1, wherein said base material is a transparent film.

3. The base material processing apparatus according to claim 2, wherein
said mark detector includes:
a light-projecting part that projects light toward a front side of said base material; and
a light-receiving part that receives the light from said light-projecting part on a rear side of said base material.

4. The base material processing apparatus according to claim 1, further comprising:
a mark applicator that applies said mark at an applying position upstream of said transport path from said detecting position to the end of said base material in said width direction.

5. The base material processing apparatus according to claim 4, further comprising:
a second mark detector that acquires a second detection result by detecting said mark continuously or intermittently at a second detecting position downstream of said transport path from said detecting position, wherein
said calculating unit calculates at least any of a transport speed of said base material, the amount of positional deviation of said base material in said transport direction, and tension on said base material applied in said transport direction by comparing said detection result and said second detection result.

6. The base material processing apparatus according to claim 4, wherein said mark is a periodic pattern.

7. The base material processing apparatus according to claim 4, wherein said mark is a continuous pattern.

8. The base material processing apparatus according to claim 7, wherein said mark is a pattern with waves.

9. The base material processing apparatus according to claim 4, wherein said mark applicator is a processing unit that performs a process on a surface of said base material.

10. The base material processing apparatus according to claim 9, wherein
said processing unit is an image recording unit that records an image by ejecting ink to the surface of said base material.

11. The base material processing apparatus according to claim 10, further comprising:
an image recording time correcting unit that corrects timing of ejection of the ink from said image recording unit on the basis of a calculation result obtained by said calculating unit.

12. The base material processing apparatus according to claim 10, further comprising:
a transport motion correcting unit that corrects a motion of said transport mechanism on the basis of a calculation result obtained by said calculating unit.

13. The base material processing apparatus according to claim 4, wherein said mark applicator is a plurality of image recording units arranged at intervals along said transport path, the image recording units recording images by ejecting different inks to a surface of said base material, said image recording units record images each functioning as said mark at respective positions differing from each other in said width direction, and said calculating unit calculates at least any of a transport speed of said base material, the amount of positional deviation of said base material in said transport direction, and tension on said base material applied in said transport direction on the basis of each of said marks applied to said positions differing in said width direction.

14. The base material processing apparatus according to claim 13, further comprising:

an image recording time correcting unit that corrects timing of ejection of the ink from each of said image recording units on the basis of a calculation result obtained by said calculating unit.

15. A base material processing method comprising:

a) applying a mark at an applying position on a transport path along which an elongated strip-shaped base material is transported by a transport mechanism in a longitudinal direction thereof, the mark being applied to an end of said base material in a width direction thereof;

b) acquiring a detection result by detecting the position of an edge of said base material in said width direction continuously or intermittently at a detecting position downstream of said transport path from said applying position; and c) implementing a filtering processing that removes a signal in a lower frequency region than a signal resulting from said mark from said detection result; and d) calculating at least any of a transport speed of said base material, an amount of positional deviation of said base material in a transport direction, and tension on said base material applied in said transport direction on the basis of said detection result and information about said mark.

16. The base material processing method according to claim 15, comprising:

e) correcting at least either timing of performing a process on a surface of said base material or the motion of said transport mechanism in consideration of a calculation result that is at least any of a transport speed of said base material, the amount of positional deviation of said base material in said transport direction, and tension on said base material applied in said transport direction, the step e) being performed after said step d).

* * * * *